US007439462B2

(12) United States Patent
McCoy

(10) Patent No.: US 7,439,462 B2
(45) Date of Patent: Oct. 21, 2008

(54) CIRCUIT BREAKER INTERLOCK DEVICES, SYSTEMS, AND METHODS

(75) Inventor: Brian Timothy McCoy, Duluth, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 11/894,479

(22) Filed: Aug. 21, 2007

(65) Prior Publication Data

US 2007/0289852 A1 Dec. 20, 2007

Related U.S. Application Data

(62) Division of application No. 11/351,817, filed on Feb. 10, 2006.

(51) Int. Cl.
*H01H 9/24* (2006.01)

(52) U.S. Cl. ..... 200/50.33; 200/5 B; 200/5 C

(58) Field of Classification Search ..... 200/5 A, 200/5 B, 5 C, 5 E, 5 EA, 50.01–50.06, 50.16, 200/50.19, 50.3–50.4, 50.33
See application file for complete search history.

(56) References Cited

U.S. PATENT DOCUMENTS

| | | | |
|---|---|---|---|
| 3,705,280 | A | 12/1972 | Harms |
| 3,778,633 | A | 12/1973 | DeVisser |
| 4,041,260 | A | 8/1977 | Swindler |
| 4,045,628 | A | 8/1977 | Schienda |
| 4,270,031 | A | 5/1981 | Borona |
| 4,286,242 | A | 8/1981 | Mrenna |
| 4,499,344 | A | 2/1985 | Castonguay |
| 4,516,100 | A | 5/1985 | Wallace |
| 4,827,089 | A | 5/1989 | Morris |
| 4,902,859 | A | 2/1990 | Witzmann |
| 4,924,041 | A | 5/1990 | Yee |
| 4,980,525 | A | 12/1990 | Kakisako |
| 5,008,499 | A | 4/1991 | Yee |
| 5,227,952 | A | 7/1993 | Romano |
| 5,393,942 | A | 2/1995 | Reiner |
| 5,486,978 | A | 1/1996 | Fishovitz |
| 5,648,646 | A | 7/1997 | Flegel |
| 5,725,085 | A | 3/1998 | Seymour |
| 5,726,401 | A | 3/1998 | Green |
| 5,763,844 | A | 6/1998 | Seymour |
| 5,814,777 | A | 9/1998 | Green |
| 5,902,974 | A | 5/1999 | Fogle |
| 5,977,492 | A | 11/1999 | Taylor |
| 6,031,193 | A | 2/2000 | Flegel |
| 6,043,439 | A | 3/2000 | Crooks |
| 6,184,595 | B1 | 2/2001 | Flegel |
| 6,617,533 | B1 | 9/2003 | Lawson |
| 6,680,445 | B1 | 1/2004 | Oravetz |
| 6,777,628 | B2 | 8/2004 | Azzola |
| 6,861,596 | B2 | 3/2005 | Schnackenberg |
| 7,126,068 | B2 | 10/2006 | Fillppenko |
| 7,238,898 | B1 | 7/2007 | Czarnecki |
| 2004/0045796 | A1 | 3/2004 | Azzola |

FOREIGN PATENT DOCUMENTS

| | | |
|---|---|---|
| EP | 1356484 | 10/2003 |

*Primary Examiner*—Elvin G Enad
*Assistant Examiner*—Marina Fishman

(57) ABSTRACT

Certain exemplary embodiments comprise a breaker interlock device adapted to mechanically resist switching a handle of a first circuit breaker from an OFF position to an ON position when a handle of a second circuit breaker is in an ON position, wherein the first circuit breaker is adjacent to the second circuit breaker.

9 Claims, 22 Drawing Sheets

CIRCUIT BREAKER INTERLOCK DEVICES, SYSTEMS, AND METHODS

CROSS-REFERENCE TO RELATED APPLICATION(S)

This application is a divisional of, claims priority to, and incorporates herein by reference in its entirety, pending U.S. patent application Ser. No. 11/351,817, titled "Circuit Breaker Interlock Devices, Systems, and Methods", filed 10 Feb. 2006.

BACKGROUND

United States Patent Application No. 20040045796 (Azzola), which is incorporated by reference herein in its entirety, allegedly recites a "device for interlocking at least two single- or multipole circuit breakers, of which:—a first circuit breaker, suitable to be fixed to a mounting plate of the first and second circuit breakers;—a second circuit breaker, suitable to be fixed by virtue of fixing means to the first bracket and to be supported thereby;—an interlocking element, provided with a contoured body that is operatively coupled to the second bracket so that it can move with respect to it, the interlocking element being suitable to be rigidly connected to the second bracket, by virtue of locking means, in a chosen position in which it interacts operatively with at least the first opening/closure lever in a condition that corresponds to the opening of the first circuit breaker, preventing its movement and preventing the circuit breakers from being closed simultaneously." See Abstract.

U.S. Pat. No. 4,924,041 (Yee), which is incorporated by reference herein in its entirety, allegedly recites a "universal circuit breaker interlock arrangement allows two circuit breakers to be interlocked such that only one of the circuit breakers is on at one time. The circuit breakers can be interlocked, per se, or when used with an electrical motor operator or with a manual rotary operator. The slidably mounted interlock arrangement also allows interlock function between two electric switches as well as between an electric switch." See Abstract.

U.S. Pat. No. 5,763,844 (Seymour), which is incorporated by reference herein in its entirety, allegedly recites a "circuit breaker interlock arrangement of the invention utilizes a pair of detector assemblies, one mounted on the rear surface of each one of a pair of first and second adjoining circuit breakers and interconnected by means of an elongated rod. The operating mechanism tripping plunger rod in the first circuit breaker trips the associated first circuit breaker operating mechanism to open the first circuit breaker contacts when an attempt is made to close the first circuit breaker contacts when the second circuit breaker contacts in the second circuit breaker are already closed, and vice versa." See Abstract.

SUMMARY

Certain exemplary embodiments comprise a breaker interlock device adapted to mechanically resist switching a handle of a first circuit breaker from an OFF position to an ON position when a handle of a second circuit breaker is in an ON position, wherein the first circuit breaker is adjacent to the second circuit breaker.

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DEFINITIONS

Figure 1:
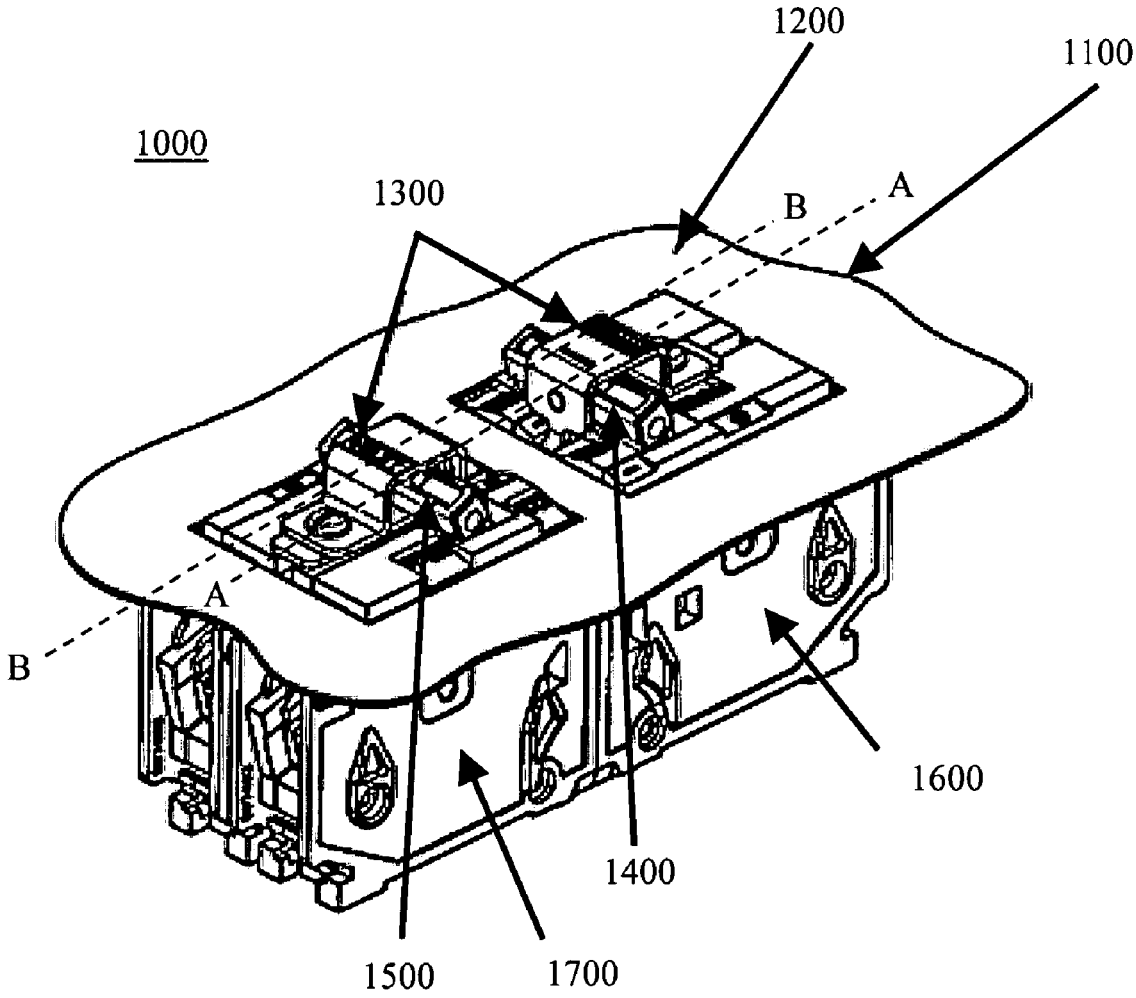
FIG. 1 is a perspective view of an exemplary embodiment of a system 1000.

When the following terms are used substantively herein, the accompanying definitions apply:

a—at least one.

activity—an action, act, step, and/or process or portion thereof.

adapted to—capable of performing a particular function.

adjacent—close to but not necessarily touching.

and/or—either in conjunction with or in alternative to.

approximately—nearly the same as.

associated—related to.

attach—to fasten, secure, couple, and/or join.

boomerang-shaped latch—a swivelable bar characterized by a curved or non-straight shape that comprises a first joined leg and a second joined leg. The first joined leg defines a first longitudinal axis and the second joined leg defines a second longitudinal axis. The first longitudinal axis intersects the second longitudinal axis at an oblique angle.

circuit breaker—automatic switch that stops the flow of electric current in an overloaded or otherwise stressed electric circuit.

breaker interlock device—a device adapted to regulate operation of a first breaker relative to a second breaker.

breaker panel—a housing adapted to contain electrical components, such as circuit interrupters and/or circuit breaker, adapted to manage electrical energy to an electrical device and/or in a circuit. A breaker panel can be adapted to manage provision of electrical energy, at least on a temporary basis, to an electrical device such as an electrically powered tool, light, motor, information device, power strip, breaker panel, and/or machine, etc. A breaker panel can be adapted, for example, to supply electrical energy at a location such as a home, industrial facility, office building, warehouse, store, commercial building, medical facility, school, government building, construction site, sports facility, mobile plant, camp site, recreational facility, trailer home, emergency site, and/or a farm, etc. A breaker panel can be fabricated from a material such as a plastic material, aluminum, stainless steel, and/or painted carbon steel, etc. A breaker panel can define a substantially rectangular cross section.

breaker retainer—a device adapted to resist motion of a breaker relative to a breaker panel.

can—is capable of, in at least some embodiments.

cavity—a hollow area within an object.

clip—(n) a device adapted to hold a first object together with respect to a second object.

clip—(v) to fasten with a clip.

comprising—including but not limited to.

contact—to touch a surface of.

dead front—a surface of a breaker panel adapted to cover one or more electrical components comprised in the breaker panel.

define—to establish the outline, form, or structure of.

determine—ascertain, obtain, and/or calculate.

ear—a protrusion from an object.

electrically coupled—connected in a manner adapted to transfer electrical energy.

fasten—to attach to something else and/or to hold something in place.

fastener—one (or more) restraint that attaches to, extends through, penetrates, and/or holds something. For example, a fastener can be one (or more) bolt and nut assembly, rivet, weldment, nail, screw, peg, staple, clip, buckle, clasp, clamp, hook and loop assembly, adhesive, and/or plastic push rivet, etc.

function—to perform as expected when applied.

handle—a part of a circuit breaker that is designed to turn the breaker ON or OFF.

hole—a hollowed place in an object.

house—to enclose, cover, and/or protect.

install—to connect or set in position and prepare for use.

label—an item used to identify something.

length—a measurement of the extent of something along a greatest dimension.

locate—to position.

location—a place substantially approximating where something physically exists.

lateral axis—a straight line defined parallel to an object's width and passing through a centroid of the object.

longitudinal axis—a straight line defined parallel to an object's length and passing through a centroid of the object.

may—is allowed and/or permitted to, in at least some embodiments.

mechanically—in a mechanical manner; by a mechanism.

mechanically couple—to join together in a mechanical manner; by a mechanism.

method—a process, procedure, and/or collection of related activities for accomplishing something.

motion—changing position or place.

movement—a change in position from one location to another.

OFF position—a position of a circuit breaker handle adapted to resist conductance of an electrical current through the circuit breaker.

ON position—a position of a circuit breaker handle adapted to allow conductance of an electrical current through the circuit breaker.

opposing—on an opposite side as compared to something else.

overlap—to extend over and cover a part of.

parallel—of, relating to, or designating two or more straight coplanar lines that do not intersect.

partially—to a degree; not totally.

perpendicular—intersecting at or forming substantially right angles.

place—to put in a particular place or position.

plate—a flat rigid body.

plurality—the state of being plural and/or more than one.

portion—a part that is less than a larger whole.

position—a manner in which a thing is positioned and/or placed.

predetermined—established in advance.

primary—first in an ordering.

provide—to furnish and/or supply.

receive—accept something provided and/or given.

relative—in comparison with.

release—to free from a restraint.

remove—to take off.

resist—to oppose.

retain—to restrain or guide.

retainer clip—a clip adapted to resist motion of one object relative to another.

said—when used in a system or device claim, an article indicating a subsequent claim term that has been previously introduced.

the—when used in a system or device claim, an article indicating that a claim is dependent upon a prior claim.

section—a defined part of an object.

secondary—second in an ordering.

separated—not touching. Spaced apart by something.

side—a surface bounding a solid object.

side-by-side orientation—a positioning of a first circuit breaker and a second circuit breaker such that said first circuit breaker and said second circuit breaker are adjacent and that a first axis defined by a direction of travel of a handle of said first circuit breaker is substantially parallel to a second axis defined by a direction of travel of a handle of said second circuit breaker.

slidable plate receiving slot—a slot adapted to surround a slidable plate and allow motion thereof relative to the slot.

slide—to, in a smooth and/or continuous motion, move one object relative to another.

slot—an opening having a longer length than a width of the opening.

snap—to open, close, and/or fit together with a click.

stationary—not moving relative to something else.

stud—a small protrusion projecting from a surface.

substantially—to a great extent or degree.

sub-system—a part of a system less than a whole of the system.

switch—(v) to electrically energize or de-energize.

system—a collection of mechanisms, devices, and/or instructions, the collection designed to perform one or more specific functions.

tertiary—third in an ordering.

therefrom—from a place, time, or thing.

upper—in a high position relative to something else.

via—by way of and/or utilizing.

width—a measurement of the extent of something along a dimension.

DETAILED DESCRIPTION

Certain exemplary embodiments comprise a breaker interlock device adapted to mechanically resist switching a handle of a first circuit breaker from an OFF position to an ON position when a handle of a second circuit breaker is in an ON position, wherein the first circuit breaker is adjacent to the second circuit breaker.

Certain exemplary embodiments comprise a breaker interlock device adapted to interlock two circuit breakers and prevent both circuit breakers from being in an ON position at the same time. Interlocked breakers can be vertically adjacent, in a side-by-side orientation, and/or in an offset orientation, etc.

An exemplary breaker interlock device can be utilized in a situation where either a "utility" power company and/or a "standby" energy source, such as a backup generator, can supply power to a load center. The breaker interlock device can be adapted to function and stay in place with or without a dead front attached to a panel comprising the breaker interlock device. Utilizing the breaker interlock device might not involve any modifications to the dead front, breakers comprised in the panel, and/or another part of the load center.

Certain exemplary breaker interlock devices can be used on one, two, three, and/or four pole breakers. The breaker interlock device can be constructed of any of a plurality of materials comprising steel, aluminum, copper, brass, bronze, tin, pewter, and/or plastic materials, etc. The breaker interlock device can be fastened together and/or attached to a circuit breaker with screws, clips, latches, rivets, and/or springs. Certain breaker interlock devices can comprise one or more surfaces adapted to comprise markings to identify "utility" and/or "standby" circuit breakers, and/or list a catalog number associated with a circuit breaker. Certain exemplary embodiments can provide space for an Underwriter Laboratories label. Breaker interlock assemblies can comprise certain exemplary breaker interlock devices. Certain exemplary breaker interlock assemblies can be adapted to for installations that do not substantially cover existing breaker labels. Certain exemplary breaker interlock assemblies can comprise one or more areas adapted to receive a breaker label, such as a user installable circuit identification breaker label. For example, a user can install a first label adapted to identify a breaker associated with a power supply from a utility. The user can install a second label adapted to identify a breaker associated with a power supply from a secondary power source such as a fossil fuel powered generator.

Certain breaker interlock devices can comprise a breaker interlock mechanism, which can be adapted to restrain motion of a second breaker to an ON position when a first breaker is in an ON position. In certain exemplary embodiments, the breaker interlock mechanism can be adapted to not cover, obscure, and/or impair visibility of a circuit identification label associated with the first circuit breaker and/or the second circuit breaker.

Certain exemplary embodiments can continue to function and/or remain in place with the dead front removed. The breaker interlock device can be adapted to not interfere with adjacent breakers not interlocked by the breaker interlock device. Certain breaker interlock devices can be installed without modifying dead fronts associated with breakers on which the breaker interlock devices are installed.

Certain breaker interlock devices can cantilever over a part of a particular dead front that crosses between two circuit breakers. In such embodiments, portions of the circuit breaker interlock devices can be adapted to retract to allow the dead front to be removed and/or installed. Certain exemplary embodiments can be installed with a screwdriver. Certain exemplary embodiments can be adapted to be reversible in their installation on exemplary circuit breakers. Certain breaker interlock devices can be installed after removing a "twist out" comprised in a particular style of dead front. A twist out can be an area in a dead front that is partially cut out of the surface and can be adapted to be removed by hand to make room for a circuit breaker escutcheon to protrude through the dead front. Certain breaker interlock devices can be adapted for attachment to circuit breakers by snapably attaching them to respective circuit breakers.

FIG. 1 is a perspective view of an exemplary embodiment of a system 1000, which can comprise a breaker panel 1100. Breaker panel 1100 can comprise a dead front 1200. Breaker panel 1100 can be adapted to releasably house a plurality of circuit breakers, such as a circuit breaker 1600 and a circuit breaker 1700. Circuit breaker 1600 and circuit breaker 1700 can be adjacent in breaker panel 1100. Circuit breaker 1600 can comprise a handle 1400. Circuit breaker 1700 can comprise a handle 1500. Each of circuit breaker 1600 and/or circuit breaker 1700 can comprise any number of poles, such as, one, two, three, or four poles, etc. Circuit breaker 1600 can define a first longitudinal axis A. Circuit breaker 1700 can define a second longitudinal axis B. In certain exemplary embodiments, first longitudinal axis A can be substantially parallel to, and offset from by a predetermined gap, second longitudinal axis B. In certain exemplary embodiments, first longitudinal axis A can be substantially colinear with second longitudinal axis B.

Handle 1400 and handle 1500 can be mechanically coupled via a breaker interlock device 1300. Breaker interlock device 1300 can be adapted to prevent handle 1500 to be switched from an OFF position to an ON position while handle 1400 is in an ON position. In certain exemplary embodiments, dead front 1200 can be removable with breaker interlock device 1300 installed. In certain exemplary embodiments, breaker interlock device 1300 can function with dead front 1200 removed from breaker panel 1100.

Figure 2:
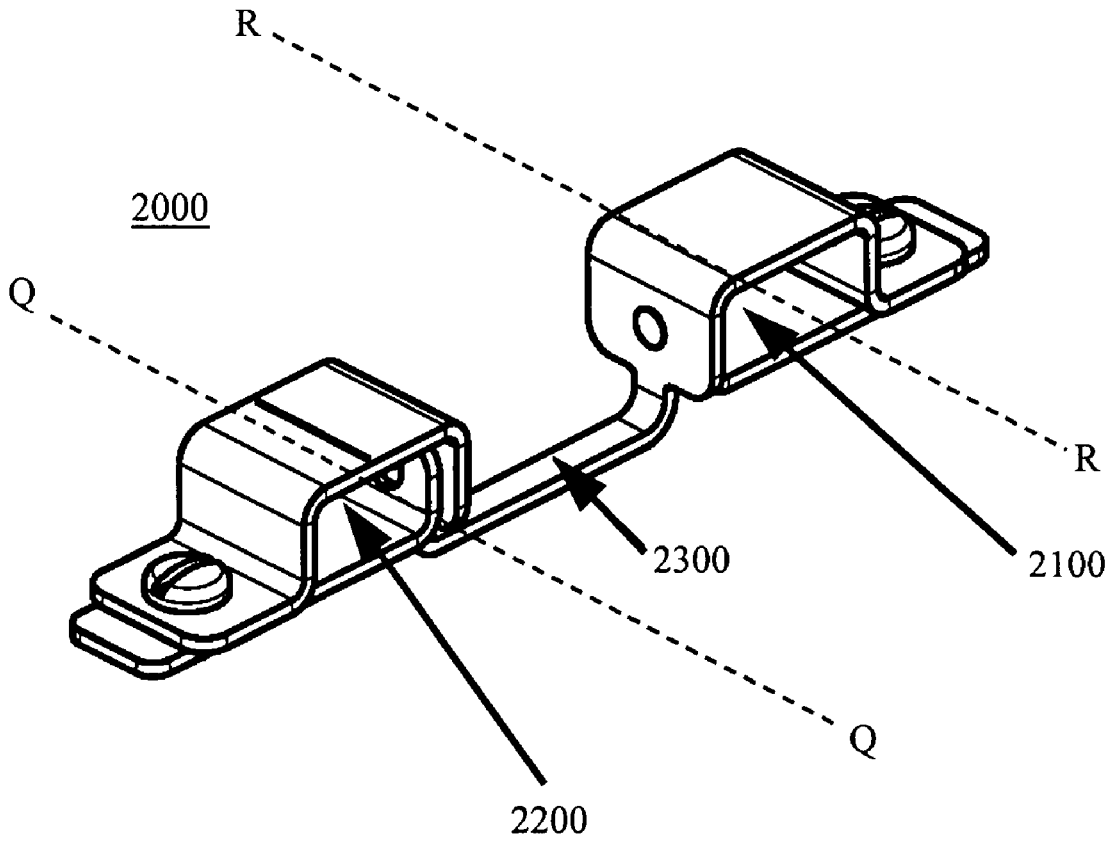
FIG. 2 is a perspective view of an exemplary embodiment of a breaker interlock device 2000.

FIG. 2 is a perspective view of an exemplary embodiment of a breaker interlock device 2000, which can be adapted for use in system 1000 of FIG. 1 as breaker interlock device 1300. Breaker interlock device 1300 can define a first cavity 2100 adapted to receive a handle of a first circuit breaker. Breaker interlock device 2000 can define a second cavity 2200 adapted to receive a handle of a second circuit breaker. Parts of breaker interlock device 2000 defining first cavity 2100 and second cavity 2200 can be coupled via a connecting strip 2300. Connecting strip 2300 can be adapted to maintain a substantially fixed distance between a lateral centerline R defined by first cavity 2100 and a lateral centerline Q defined by second cavity 2200.

Figure 3:
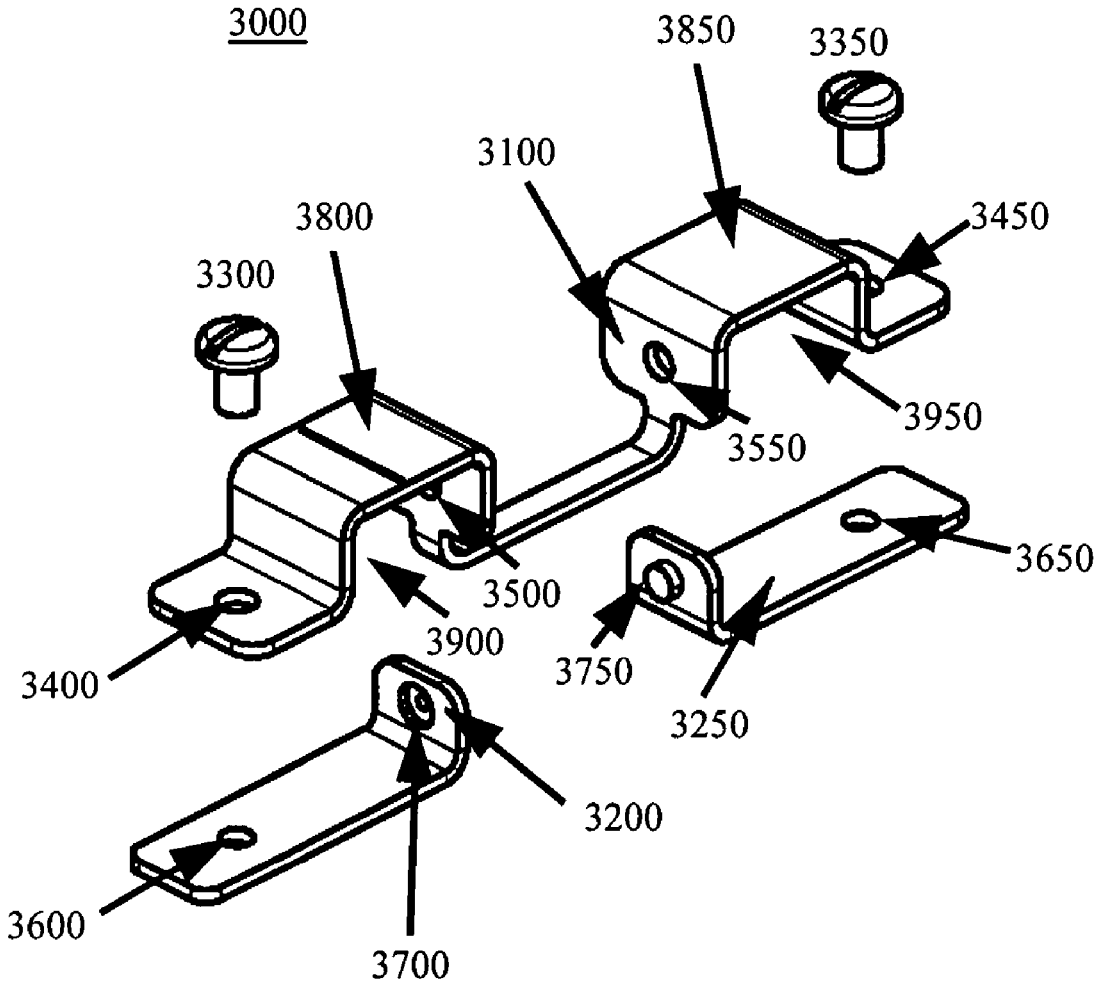
FIG. 3 is an exploded perspective view of an exemplary embodiment of a breaker interlock device 3000.

FIG. 3 is an exploded perspective view of an exemplary embodiment of a breaker interlock device 3000, which can be adapted for use in system 1000 of FIG. 1 as breaker interlock device 1300. Breaker interlock device 3000 can comprise an upper portion 3100 that can partially define a first cavity 3900 adapted to receive a handle of a first breaker and a second cavity 3950 adapted to receive a handle of a second breaker. Upper portion 3100 can define a first fastener receiving hole 3400 and a second fastener receiving hole 3450. Upper portion 3100 can comprise a first circuit identification labeling area 3800 and a second circuit identification labeling area 3850. In operative embodiments, each of first circuit identification labeling area 3800 and second circuit identification labeling area 3850 can be adapted to receive a label identifying a breaker associated with a respective handle held by first cavity 3900 and/or second cavity 3950. Upper portion 3100 can define a first stud receiving hole 3500 and a second stud receiving hole 3550. Each of first stud receiving hole 3500 and second stud receiving hole 3550 can be adapted to receive a stud adapted to restrain motion of one or more of a first lower portion 3200 and a second lower portion 3250.

In assembled embodiments, first lower portion 3200 can partially define first cavity 3900. First lower portion 3200 can define a third fastener receiving hole 3600. First lower portion 3200 can be releasably attachable to upper portion 3100 via a first fastener 3300. First fastener 3300 can be adapted to fasten upper portion 3100 to first lower portion 3200 via first fastener receiving hole 3400 and third fastener receiving hole 3600. First lower portion 3200 can comprise a stud 3700. In certain exemplary embodiments, stamping first lower portion 3200 can form stud 3700. In certain exemplary embodiments, stud 3700 can be adapted to be placed in first stud receiving hole 3500, thereby restraining motion of first lower portion 3200 relative to upper portion 3100.

In assembled embodiments, second lower portion 3250 can partially define second cavity 3950. Second lower portion 3250 can define a fourth fastener receiving hole 3650. Second lower portion 3250 can be releasably attachable to upper portion 3100 via a second fastener 3350. Second fastener 3350 can be adapted to fasten upper portion 3100 to second lower portion 3250 via second fastener receiving hole 3450 and fourth fastener receiving hole 3650. Second lower portion 3250 can comprise a stud 3750. In assembled embodiments, stud 3750 can be adapted to be placed in second stud receiving hole 3550, thereby restraining motion of second lower portion 3250 relative to upper portion 3100.

Figure 4:
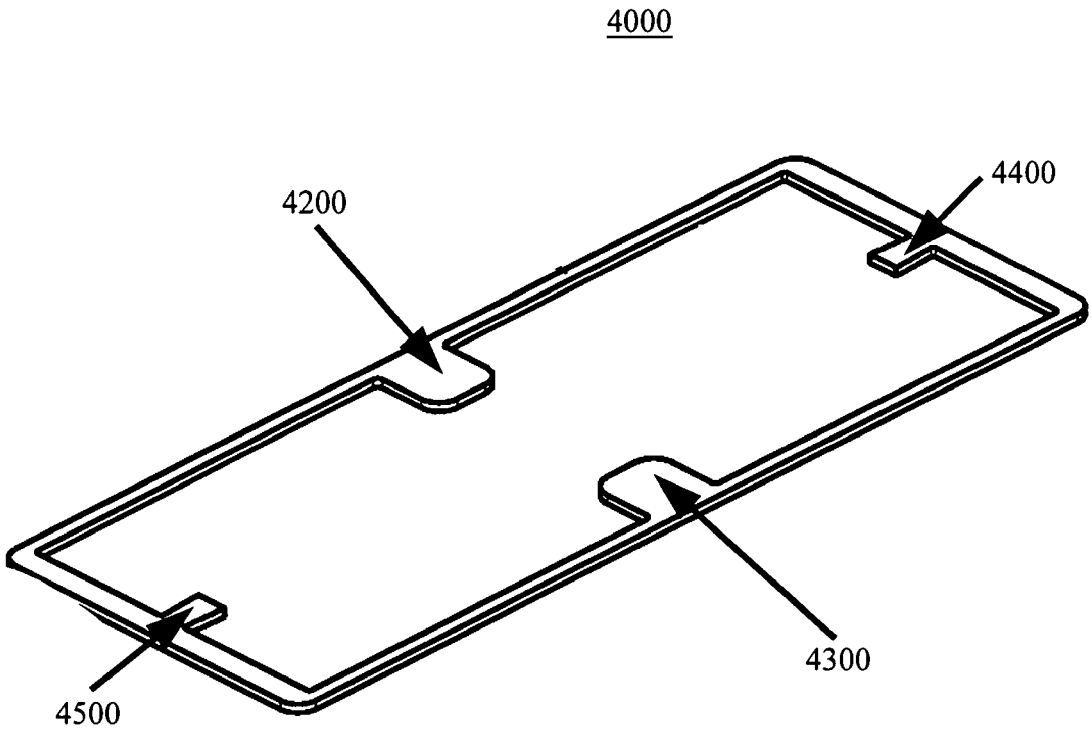
FIG. 4 is a perspective view of an exemplary embodiment of a breaker retainer 4000.

FIG. 4 is a perspective view of an exemplary embodiment of a breaker retainer 4000, which can be adapted for use in system 1000 of FIG. 1, such as by being positioned beneath dead front 1200 to maintain the positions and/or alignment of breakers 1600 and 1700 relative to each other. Breaker retainer 4000 can comprise a first alignment tab 4200, a second alignment tab 4300, a third alignment tab 4400, and a fourth alignment tab 4500. First alignment tab 4200 can be on an opposing edge of breaker retainer 4000 from second alignment tab 4300. Third alignment tab 4400 can be on an opposing edge of breaker retainer 4000 from fourth alignment tab 4500. In assembled embodiments, breaker retainer 4000 can be releasably attached to a first circuit breaker and a second circuit breaker. Breaker retainer 4000 can be adapted to resist motion of the first circuit breaker and/or the second circuit breaker relative to a breaker panel. Breaker retainer 4000 can comprise one or more areas, such as at first alignment tab 4200 and/or a second alignment tab 4300 that can receive a label and/or markings. The label and/or markings can provide a warning of an electrical hazard associated with a circuit breaker associated with breaker retainer 4000. In certain exemplary embodiments, breaker retainer 4000 can be sufficiently narrow so as not to interfere with one or more adjacent circuit breakers.

Figure 5:
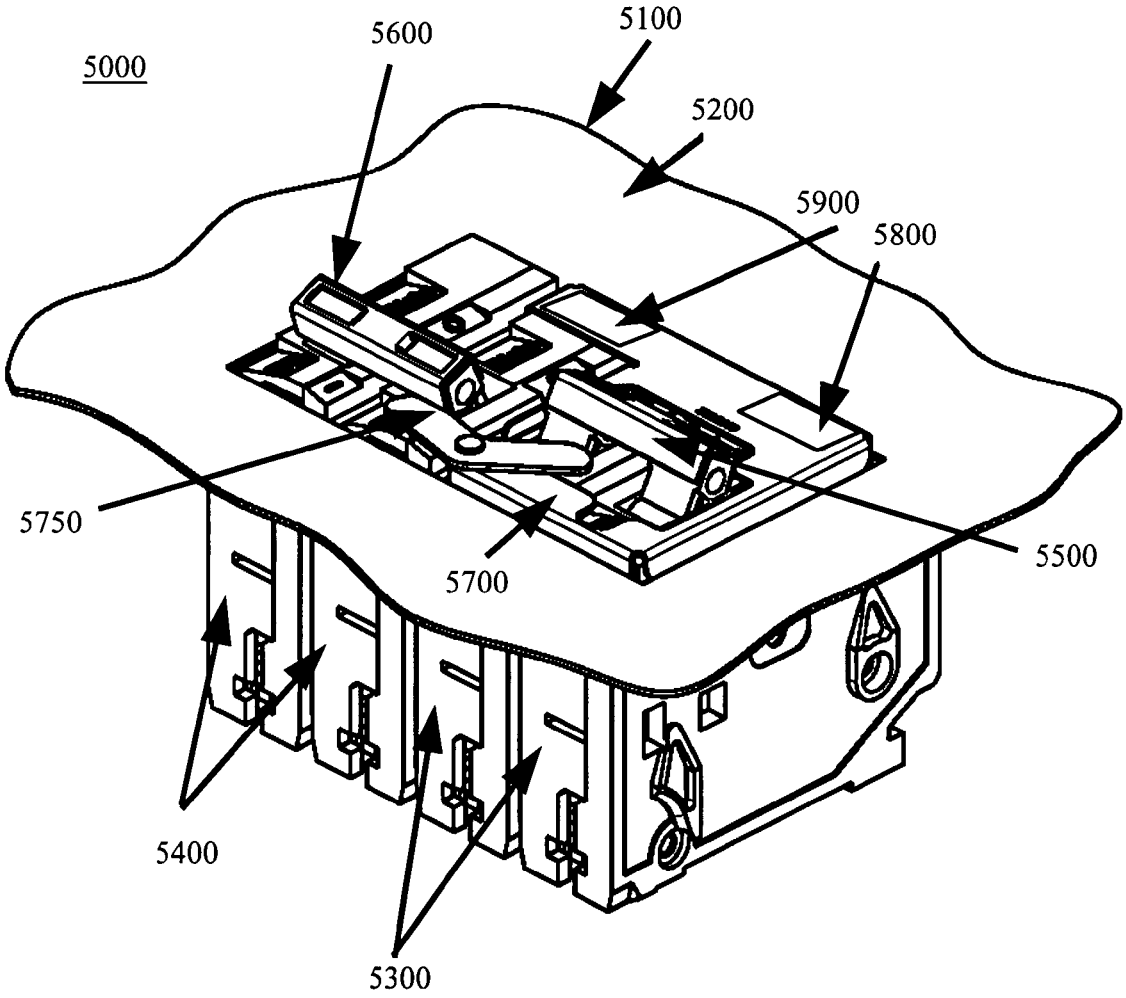
FIG. 5 is a perspective view of an exemplary system 5000.

FIG. 5 is a perspective view of an exemplary system 5000, which can comprise a breaker panel 5100. Breaker panel 5100 can comprise a dead front 5200. Breaker panel 5100 can be adapted to releasably house one or more circuit breakers such as a circuit breaker 5300 and a circuit breaker 5400. Each of circuit breaker 5300 and/or circuit breaker 5400 can comprise any number of poles, such as, one, two, three, or four poles, etc.

System 5000 can comprise a breaker interlock device 5700, which can be adapted restrain motion of a handle 5600 of circuit breaker 5400 from an OFF position to an ON position when a handle 5500 of circuit breaker 5300 is in an ON position. Breaker interlock device 5700 can comprise a boomerang shaped latch 5750. Breaker interlock device 5700 can comprise a first circuit identification labeling area 5800 and/or a second circuit identification labeling area 5900. In operative embodiments, each of first circuit identification labeling area 5800 and second circuit identification labeling area 5900 can be adapted to receive a label identifying respectively circuit breaker 5300 and circuit breaker 5400. For example, labels attached to first circuit identification labeling area 5800 and/or second circuit identification labeling area 5900 can identify a utility circuit breaker and/or a standby circuit breaker.

Breaker interlock device 5700 can be adapted for use in an operative embodiment wherein circuit breaker 5300 is adjacent to circuit breaker 5400. Breaker interlock device 5700 can be adapted for use wherein circuit breaker 5300 and circuit breaker 5400 are in a side-by-side orientation. In certain exemplary embodiments, dead front 5200 can be removable with breaker interlock device 5700 installed. In certain exemplary embodiments, breaker interlock device 5700 can function with dead front 5100 removed from breaker panel 5100.

Figure 6:
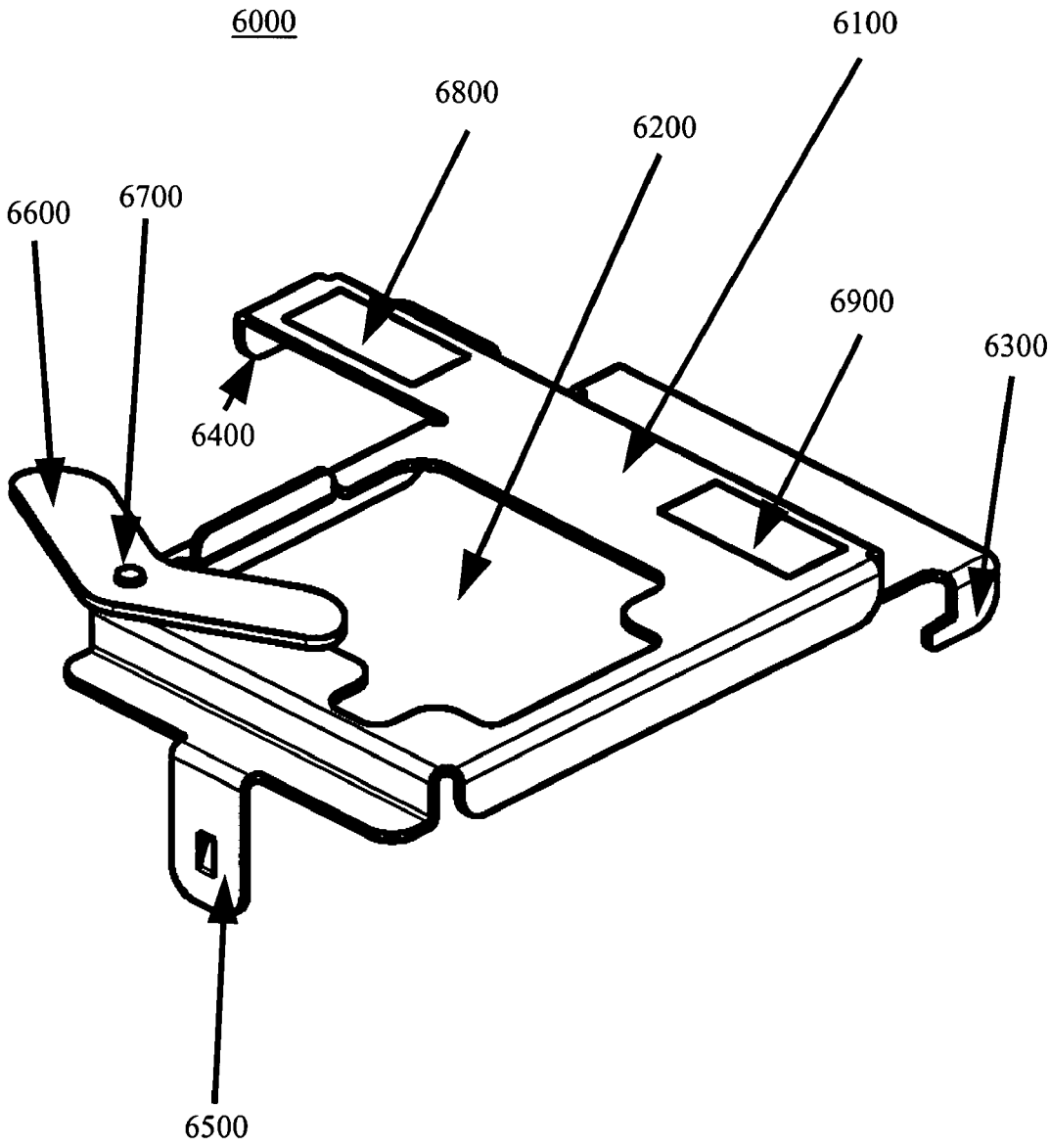
FIG. 6 is a perspective view of an exemplary embodiment of a breaker interlock device 6000.

FIG. 6 is a perspective view of an exemplary embodiment of a breaker interlock device 6000, which can be adapted for use in system 5000 of FIG. 5 as breaker interlock device 5700. Breaker interlock device 6000 can comprise a faceplate 6100. In certain exemplary embodiments, faceplate 6100 can define an opening 6200. Opening 6200 can be adapted to receive a handle of a first circuit breaker and/or a handle of a second circuit breaker. Breaker interlock device 6000 can comprise a first ear 6300, a second ear 6400, and/or a clip 6500. First ear 6300, second ear 6400, and/or clip 6500 can be adapted to clipably and/or snapably attach breaker interlock device 6000 to the first circuit breaker, the second circuit breaker, a component attached to a breaker panel and/or the breaker panel, etc. First ear 6300, second ear 6400, and/or clip 6500 can provide a relatively secure attachment of breaker interlock device 6000 to the first circuit breaker and/or the second circuit breaker. In certain exemplary embodiments, breaker interlock device 6000 can overlap a surface of each of the first circuit breaker and the second circuit breaker.

Breaker interlock device 6000 can comprise a boomerang-shaped latch 6600, which can be fixedly and/or releasably attached to faceplate 6100 via a fastener 6700. Boomerang-shaped latch 6600 can be adapted to contact the handle of the first circuit breaker and/or the handle of the second circuit breaker. Boomerang-shaped latch 6600 can be adapted to resist motion of the handle of the first circuit breaker from an OFF first position to an ON second position unless the handle of the second circuit breaker is in an OFF position. Breaker interlock device 6000 can comprise a first circuit identification labeling area 6800 and/or a second circuit identification labeling area 6900. In operative embodiments, each of first circuit identification labeling area 6800 and second circuit identification labeling area 6900 can be adapted to receive a label comprising information regarding the first circuit breaker, the second circuit breaker, and/or the breaker panel. The shape, placement, and/or operation of boomerang-shaped latch 6600 can be adapted to avoid covering and/or impeding visibility of first circuit identification labeling area 6800 and/or second circuit identification labeling area 6900.

Figure 7:
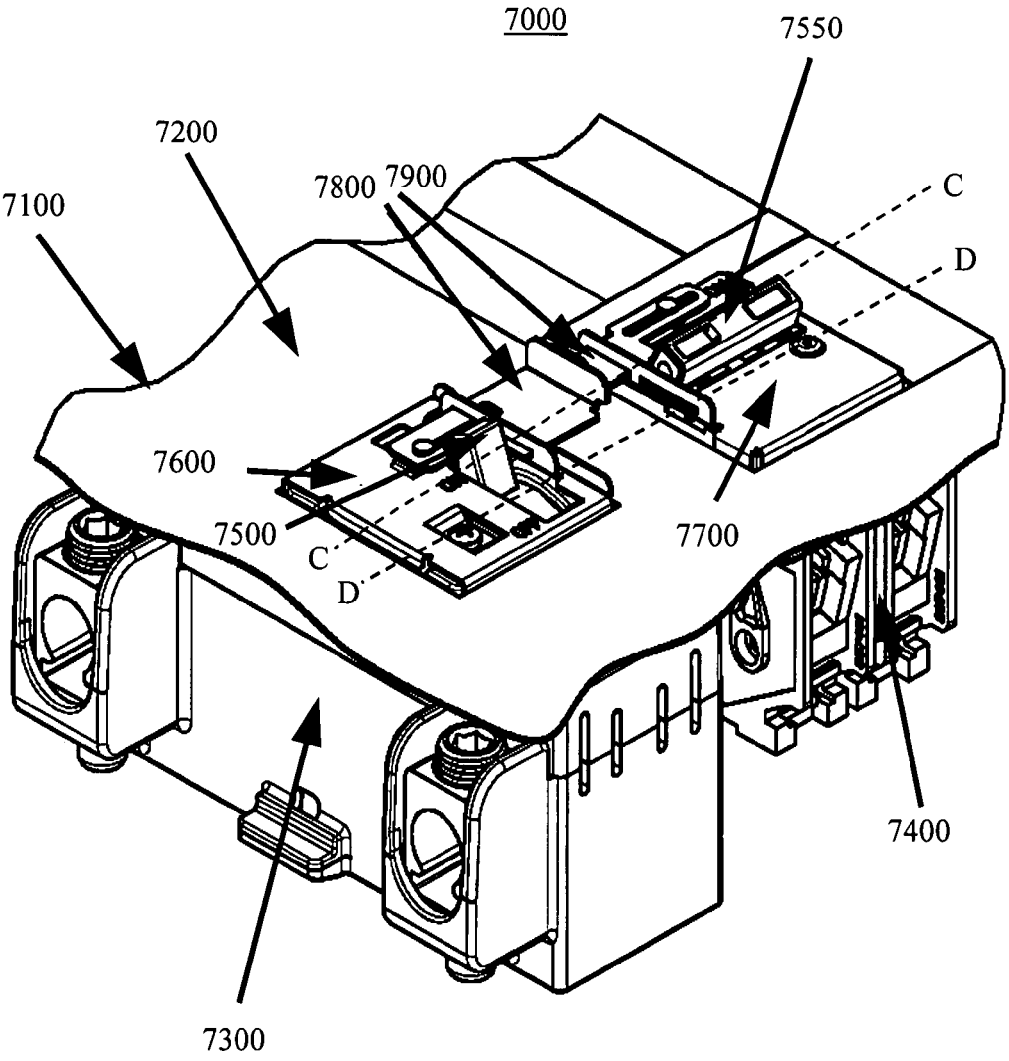
FIG. 7 is a perspective view of an exemplary system 7000.

FIG. 7 is a perspective view of an exemplary system 7000, which can comprise a breaker panel 7100. Breaker panel 7100 can comprise a dead front 7200. Breaker panel 7100 can be adapted to releasably house a circuit breaker 7300 and a circuit breaker 7400. In certain exemplary embodiments, circuit breaker 7300 can be adjacent to circuit breaker 7400. In certain exemplary embodiments, circuit breaker 7300 and circuit breaker 7400 can be in a side-by-side orientation. In certain exemplary embodiments, circuit breaker 7300 can define a first lateral axis C and circuit breaker 7400 can define a second lateral axis D. First lateral axis C can be substantially parallel to, collinear with, and/or offset from, second lateral axis D.

System 7000 can comprise a breaker interlock device 7600, which can be adapted to mechanically resist switching a handle 7550 of circuit breaker 7400 from an OFF position to an ON position when a handle 7500 of circuit breaker 7300 is in an ON position. Breaker interlock device 7600 can comprise a faceplate assembly 7700, a first slidable plate 7800, and a second slidable plate 7900. In operative embodiments, first slidable plate 7800 can be adjacent to and/or in contact with second slidable plate 7900 either handle 7500 or handle 7550 is in an ON position.

Figure 8:
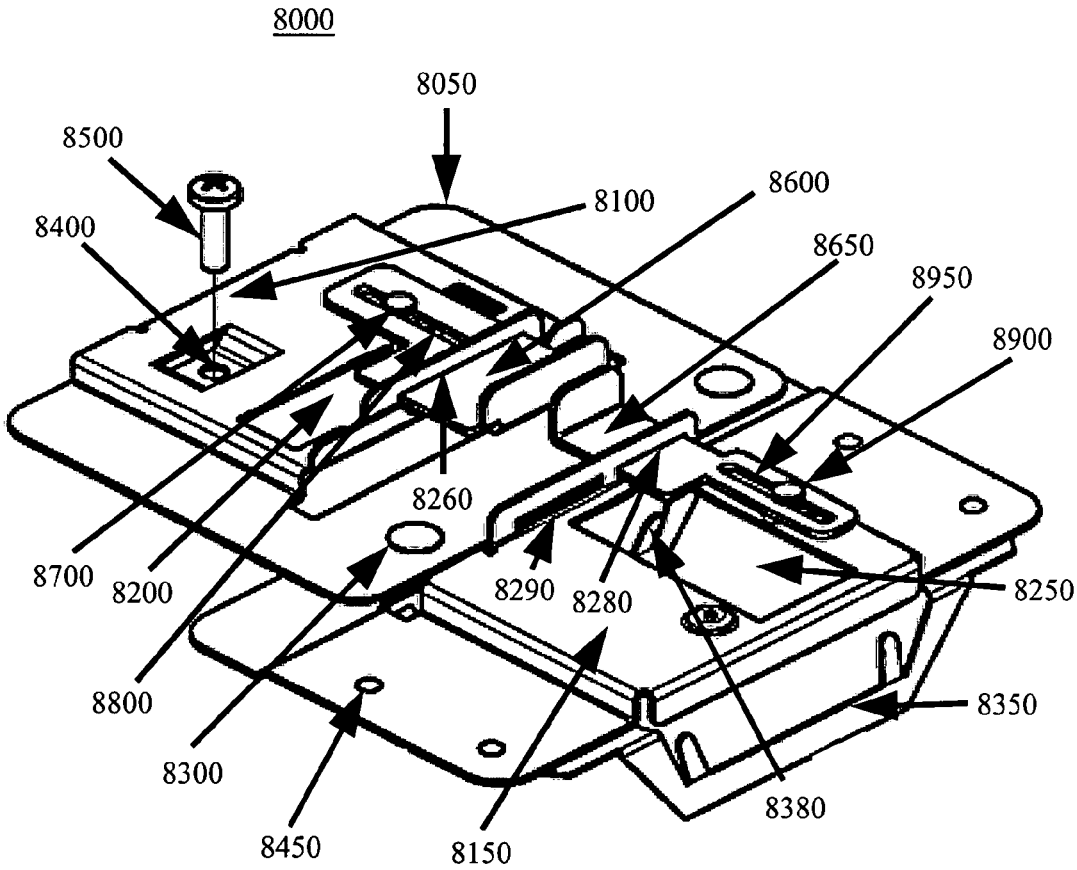
FIG. 8 is a perspective view of an exemplary embodiment of a breaker interlock device 8000.

FIG. 8 is a perspective view of an exemplary embodiment of a breaker interlock device 8000, which can be adapted for use in system 7000 of FIG. 7 as breaker interlock device 7600. Breaker interlock device 8000 can comprise a faceplate assembly 8050. In certain exemplary embodiments, faceplate 8050 can be fabricated utilizing a single faceplate. In certain exemplary embodiments, faceplate assembly 8050 can comprise a first faceplate 8100 and a second faceplate 8150. First faceplate 8100 can define a first opening 8200, which can be adapted to receive a handle of a first circuit breaker. First faceplate 8100 can define one or more slidable plate receiving slots, such as a first slidable plate receiving slot 8260. In certain operative embodiments, first slidable plate receiving slot 8260 can be adapted to encircle a first slidable plate 8600. Second faceplate 8150 can define a second opening 8250, which can be adapted to receive a handle of a second circuit breaker. Second faceplate 8150 can define one or more slidable plate receiving slots such as a second slidable plate receiving slot 8280 and/or a third slidable plate receiving slot 8290. In certain operative embodiments, first slidable plate receiving slot 8280 can be adapted to encircle a second slidable plate 8650. Third slidable plate receiving slot 8290 can be adapted to allow installation of breaker interlock device 8000 with the first breaker in one or more different orientations with respect to the second breaker. One or more fasteners, such as fastener 8300 can be adapted to fixedly and/or releasably couple first faceplate 8100 to second faceplate 8150.

Breaker interlock device 8000 can be fixedly and/or releasably attached to one or more of the first circuit breaker, the second circuit breaker, and/or a breaker panel by a first clip 8350 and/or a second clip 8380. Breaker interlock device 8000 can define one or more fastener receiving holes such as a first fastener receiving hole 8400 and a second fastener receiving hole 8450. Certain exemplary embodiments can comprise additional fastener receiving holes. Breaker interlock device 8000 can be fixedly or releasably attached to one or more of the first breaker, the second breaker, and/or the breaker panel via one or more fasteners such as a fastener 8500 via fastener receiving hole 8400.

First slidable plate 8600 can define a first slot 8800 adapted to receive a first fastener 8700. First fastener 8700 can be adapted to slidably attach first slidable plate 8600 to faceplate assembly 8050. First slidable plate 8060 can be adapted, when in a first slidable position, to resist movement of the handle of the first circuit breaker from an OFF position to an ON position. First slidable plate 8600 can be adapted, when in a second slidable position, to not resist movement of the handle of the first circuit breaker from the OFF position to the ON position.

Second slidable plate 8650 can define a second slot 8950 adapted to receive a second fastener 8900. Second fastener 8900 can be adapted to slidably attach second slidable plate 8650 to faceplate assembly 8050. Second slidable plate 8650 can be adapted, when in a primary slidable position, to resist movement of the handle of the second circuit breaker from an OFF position to an ON position. Second slidable plate 8650 can be adapted to, when in a secondary slidable position, not resist movement of the handle of the second circuit breaker from the OFF position to the ON position. Second slidable plate 8650 can be adapted to contact and/or be in proximity to first slidable plate 8600 such that first slidable plate 8600 cannot be in the first slidable position when second slidable plate 8650 is in the primary slidable position.

Figure 9:
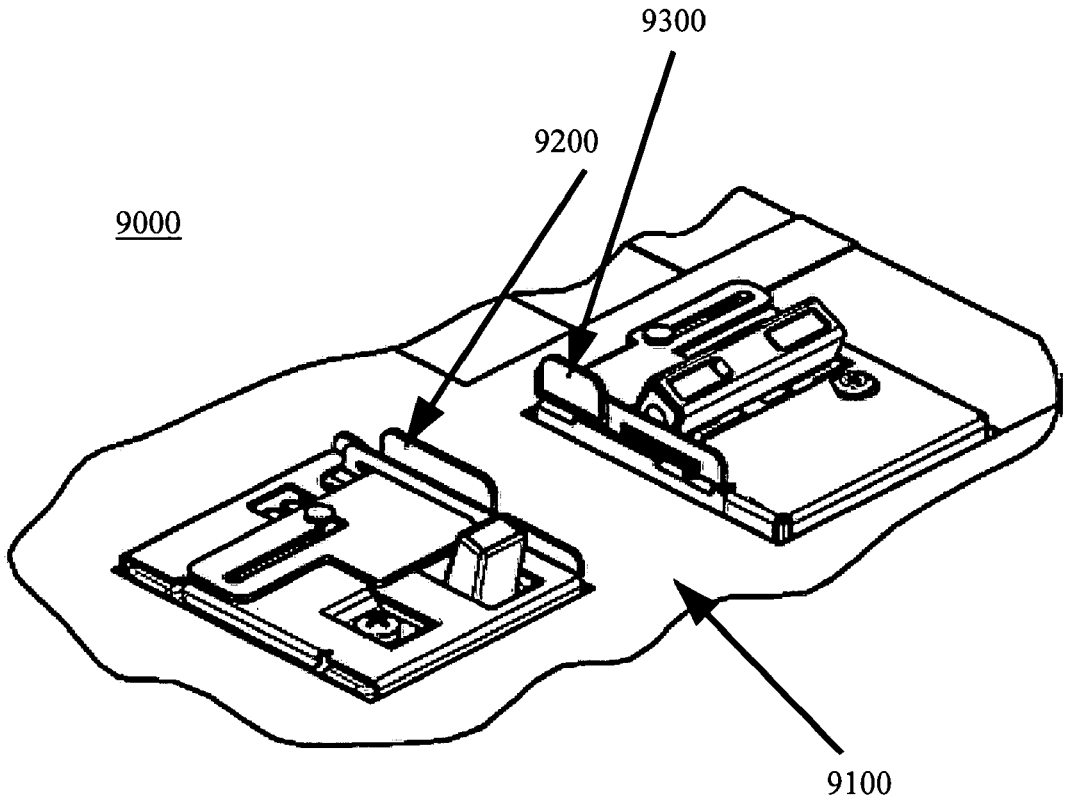
FIG. 9 is a perspective view of an exemplary system 9000.

FIG. 9 is a perspective view of an exemplary system 9000 comprising breaker interlock device 8000 of FIG. 8. In certain exemplary embodiments, a first slidable plate 9200 can be movable to a retracted slidable position, as shown, relative to a first circuit breaker 9400. A second slidable plate 9300 can be movable to a similarly retracted slidable position relative to a second circuit breaker 9500. System 9000 can comprise a breaker panel, which can comprise a dead front 9100. Dead front 9100 can be removable with first slidable plate 9200 in the retracted slidable position and second slidable plate 9300 in the similarly retracted slidable position. In certain exemplary embodiments, breaker interlock device 8000 can be adapted to function with dead front 9100 removed from the breaker panel.

Figure 10:
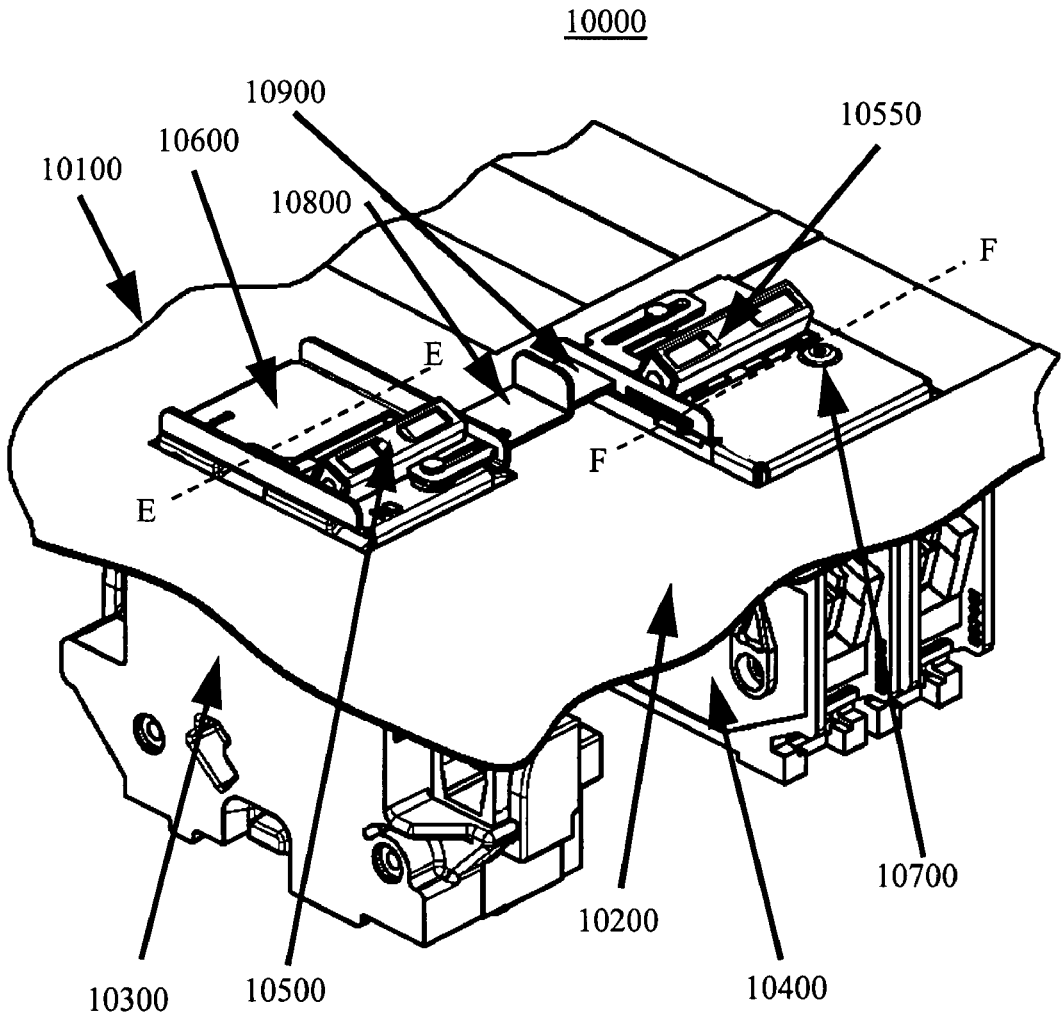
FIG. 10 is a perspective view of an exemplary system 10000.

FIG. 10 is a perspective view of an exemplary system 10000, which can comprise a breaker panel 10100. Breaker panel 10100 can comprise a dead front 10200. Breaker panel 10100 can be adapted to releasably house a circuit breaker 10300 and a circuit breaker 10400. In certain exemplary embodiments, circuit breaker 10300 can be adjacent to circuit breaker 10400. In certain exemplary embodiments, circuit breaker 10300 and circuit breaker 10400 can be in a side-by-side orientation. In certain exemplary embodiments, circuit breaker 10300 can define a first lateral axis E and circuit breaker 10400 can define a second lateral axis F. First lateral axis E can be substantially parallel to, and offset from, second lateral axis F.

System 10000 can comprise a breaker interlock device 10600, which can be adapted to mechanically resist switching a handle 10550 of circuit breaker 10400 from an OFF position to an ON position when a handle 10500 of circuit breaker 10300 is in an ON position. Breaker interlock device 10600 can comprise a faceplate assembly 10700, a first slidable plate 10800, and a second slidable plate 10900. In operative embodiments, first slidable plate 10800 can be adjacent to and/or in contact with second slidable plate 10900 with one of handle 10500 and handle 10550 in an ON position.

Figure 11:
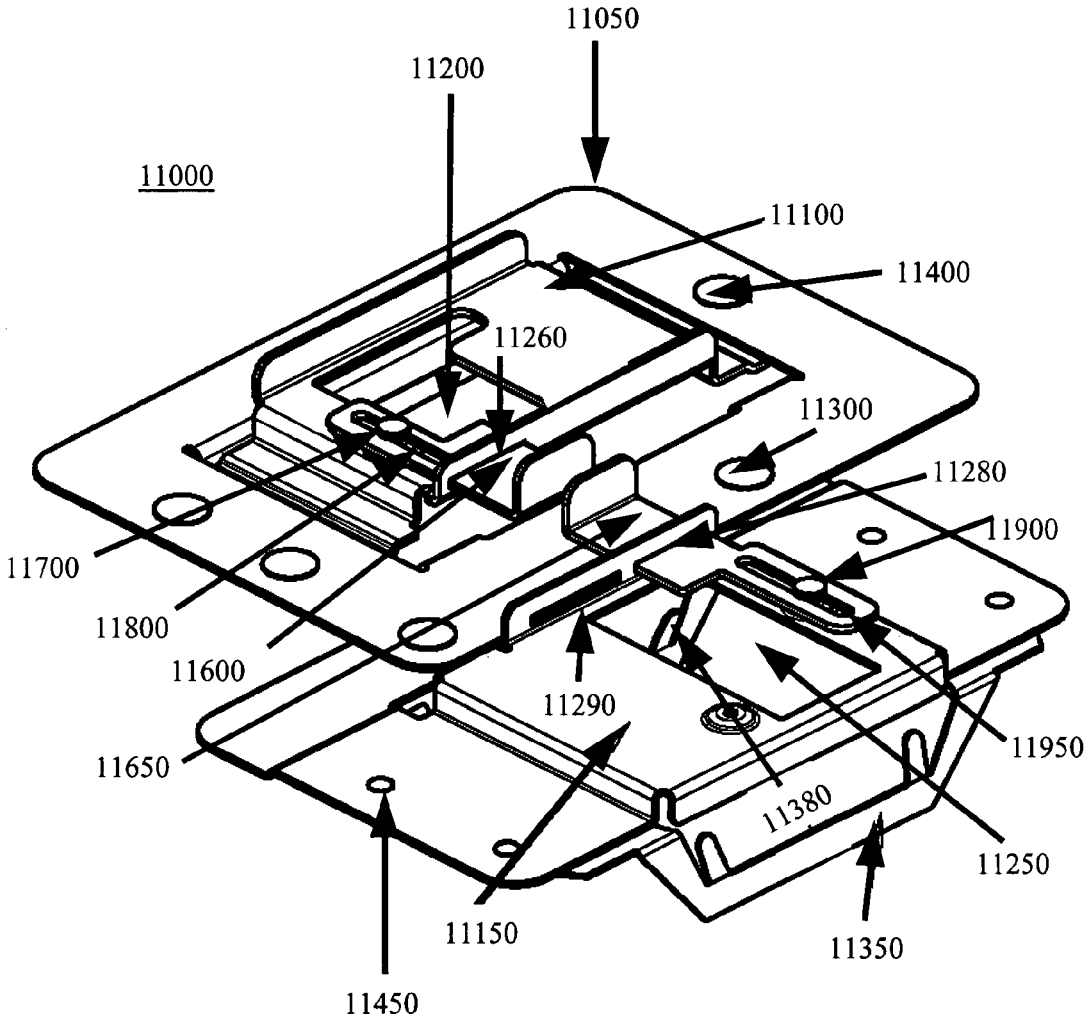
FIG. 11 is a perspective view of an exemplary embodiment of a breaker interlock device 11000.

FIG. 11 is a perspective view of an exemplary embodiment of a breaker interlock device 11000, which can be adapted for use in system 10000 of FIG. 10 as breaker interlock device 10600. Breaker interlock device 11000 can comprise a faceplate assembly 11050. In certain exemplary embodiments, faceplate assembly 11050 can be fabricated utilizing a single faceplate. In certain exemplary embodiments, faceplate assembly 11050 can comprise a first faceplate 11100 and a second faceplate 11150. First faceplate 11100 can define a first opening 11200, which can be adapted to receive a handle of a first circuit breaker. First faceplate 11100 can define one or more slidable plate receiving slots, such as a first slidable plate receiving slot 11260. In certain operative embodiments, first slidable plate receiving slot 11260 can be adapted to encircle a first slidable plate 11600. Second faceplate 11150 can define a second opening 11250, which can be adapted to receive a handle of a second circuit breaker. Second faceplate 11150 can define one or more slidable plate receiving slots such as a second slidable plate receiving slot 11280. In certain operative embodiments, first slidable plate receiving slot 11280 can be adapted to encircle a second slidable plate 11650. In embodiments wherein each of first faceplate 11100 and/or second faceplate 11150 can comprise more than one slidable plate receiving slots such as third slidable plate receiving slot 11290. A plurality of slidable plate receiving slots can be adapted to allow installation of breaker interlock device 11000 with the first breaker in one or more different orientations with respect to the second breaker.

One or more fasteners, such as fastener 11300 can be adapted to fixedly and/or releasably couple first faceplate 11100 to second faceplate 11150. Breaker interlock device 11000 can be fixedly and/or releasably attached to one or more of the first circuit breaker, the second circuit breaker, and/or a breaker panel by a first clip 11350 and/or a second clip 11380. Breaker interlock device 11000 can define one or more fastener receiving holes such as a fastener receiving hole 11450. Certain exemplary embodiments can comprise additional fastener receiving holes. Breaker interlock device 11000 can be fixedly or releasably attached to one or more of the first breaker, the second breaker, and/or the breaker panel via one or more fasteners via a first fastener receiving hole 11400 and/or a second fastener receiving hole 11450. In certain exemplary embodiments, additional receiving holes can be adapted to attach breaker interlock device 11000 to one or more of the first breaker, the second breaker, and/or the breaker panel.

First slidable plate 11600 can define a first slot 11800 adapted to receive a first fastener 11700. First fastener 11700 can be adapted to attach first slidable plate 11600 to faceplate assembly 11050. First slidable plate 11060 can be adapted, when in a first slidable position, to resist movement of the handle of the first circuit breaker from an OFF position to an ON position. First slidable plate 11060 can be adapted, when in a second slidable position, to not resist movement of the handle of the first circuit breaker from the OFF position to the ON position.

Second slidable plate 11650 can define a second slot 11950 adapted to receive a second fastener 11900. Second fastener 11900 can be adapted to attach second slidable plate 11650 to faceplate assembly 11050. Second slidable plate 11650 can be adapted, when in a primary slidable position, to resist movement of the handle of the second circuit breaker from an OFF position to an ON position. Second slidable plate 11650 can be adapted to, when in a secondary slidable position, not resist movement of the handle of the second circuit breaker from the OFF position to the ON position. Second slidable plate 11650 can be adapted to contact and/or be in proximity to first slidable plate 11600 such that first slidable plate 11600 cannot be in the first slidable position when second slidable plate 11650 is in the primary slidable position.

Figure 12:
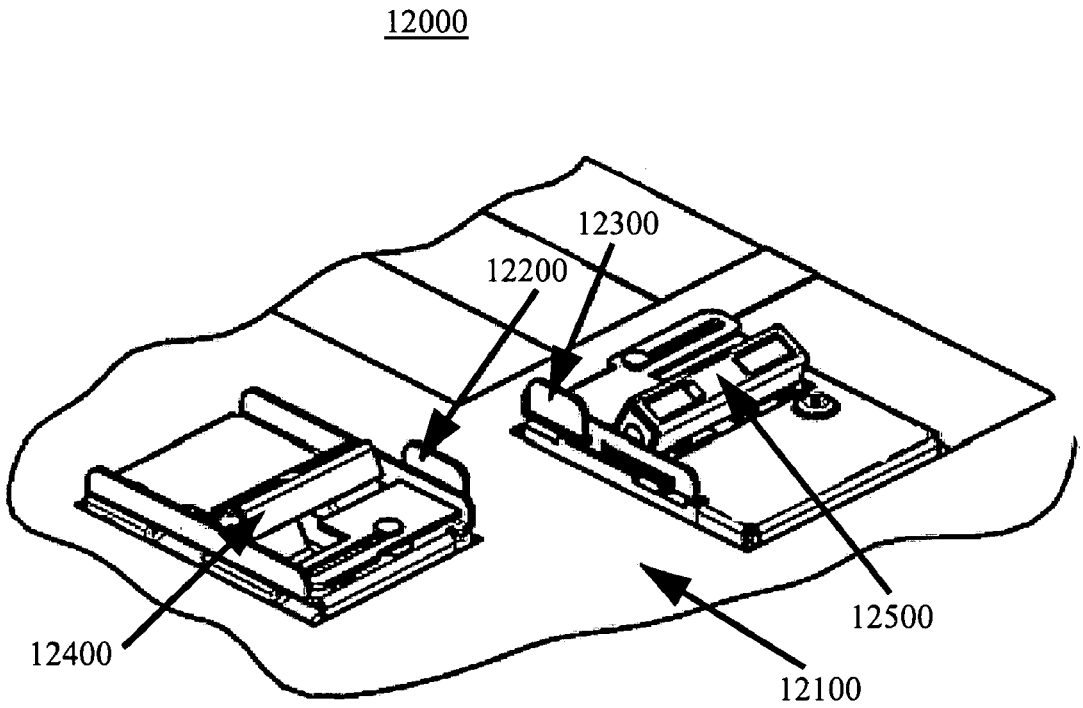
FIG. 12 is a perspective view of an exemplary system 12000.

FIG. 12 is a perspective view of an exemplary system 12000 comprising breaker interlock device 11000 of FIG. 11. In certain exemplary embodiments, a first slidable plate 12200 can be movable to a retracted slidable position, as shown, relative to a first circuit breaker 12400. A second slidable plate 12300 can be movable to a similarly retracted slidable position relative to a second circuit breaker 12500. System 12000 can comprise a breaker panel, which can comprise a dead front 12100. Dead front 12100 can be removable with first slidable plate 12200 in the retracted slidable position and second slidable plate 12300 in the similarly retracted slidable position. In certain exemplary embodiments, breaker interlock device 11000 can be adapted to function with dead front 12100 removed from the breaker panel.

Figure 13:
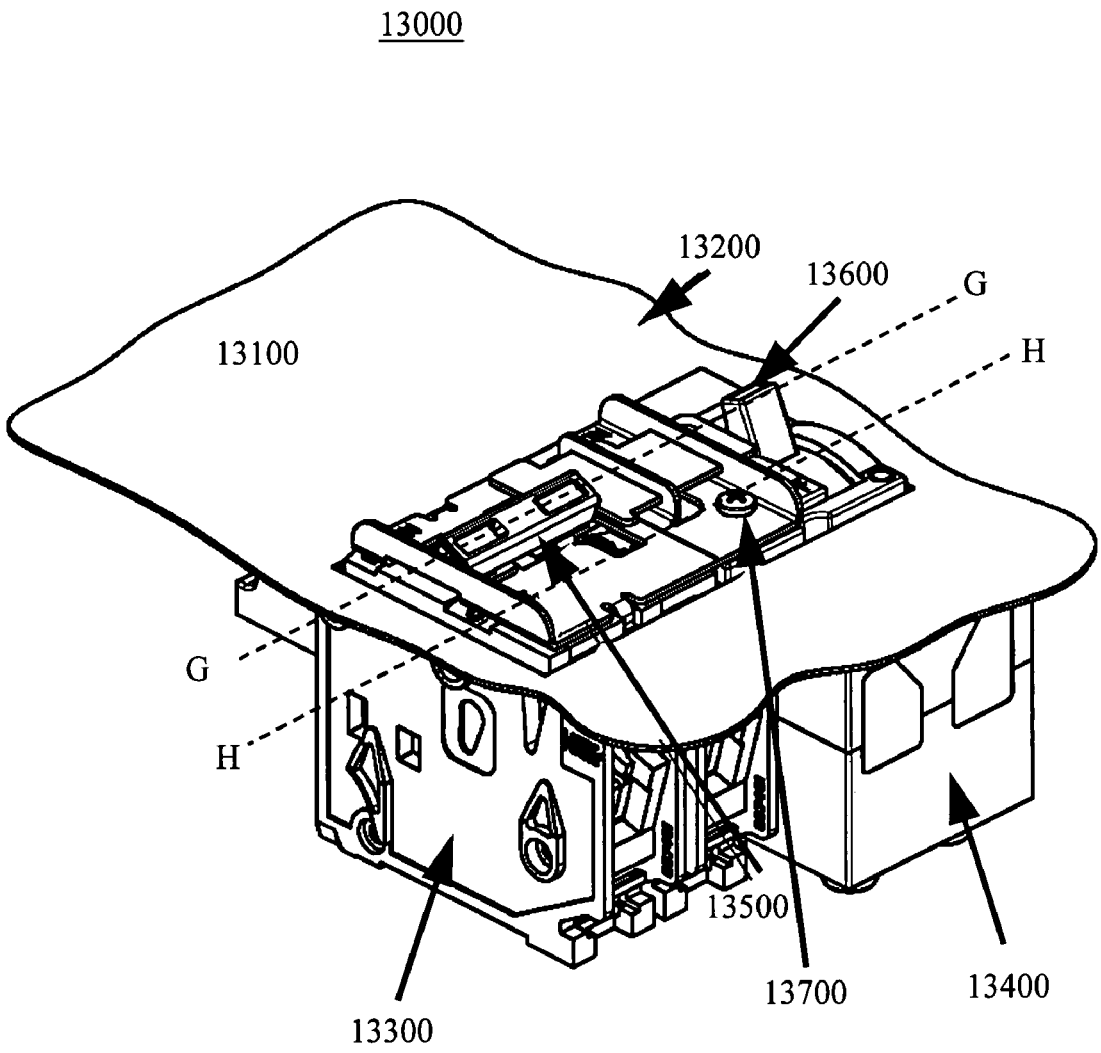
FIG. 13 is a perspective view of an exemplary system 13000.

FIG. 13 is a perspective view of an exemplary system 13000, which can comprise a breaker panel 13100. Breaker panel 13100 can comprise a dead front 13200. Breaker panel 13100 can be adapted to fixedly and/or releasably mount a first circuit breaker 13300 and a second circuit breaker 13400. First circuit breaker 13300 can comprise a handle 13500. Second circuit breaker 13400 can comprise a handle 13600. System 13000 can comprise a breaker interlock device 13700, which can be adapted to mechanically resist switching handle 13500 of first circuit breaker 13300 from an OFF position to an ON position when handle 13600 of second circuit breaker 13400 is in an ON position. In certain exemplary embodiments, first circuit breaker 13300 can be adjacent to, in a side-by-side orientation with respect to, and/or in an offset side-by-side orientation with respect to, second circuit breaker 13400. In certain exemplary embodiments, first circuit breaker 13300 can define a first lateral axis G. Second circuit breaker 13400 can define a second lateral axis H. In certain exemplary embodiments, first lateral axis G can be substantially parallel to, and/or offset from, second lateral axis H. In certain assembled embodiments, dead front 13200 can be removable with breaker interlock device 13700 installed. Breaker interlock device 13700 can be adapted to function with dead front 13700 removed.

Figure 14:
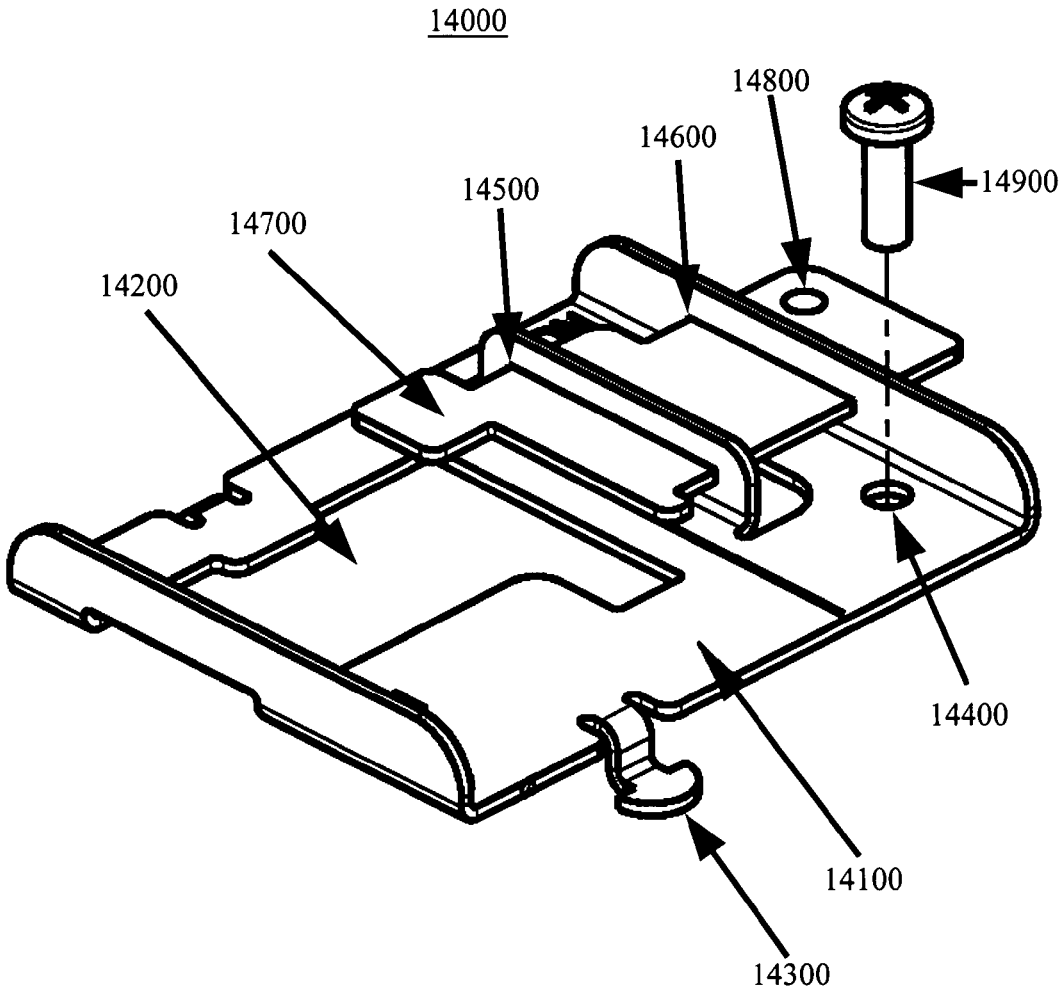
FIG. 14 is a perspective view of an exemplary embodiment of a breaker interlock device 14000.

FIG. 14 is a perspective view of an exemplary embodiment of a breaker interlock device 14000, which can be adapted for use in system 13000 of FIG. 13 as breaker interlock device 13700. Breaker interlock device 14000 can comprise a stationary plate 14100, which can be releasably attachable to a breaker panel, first circuit breaker, and/or second circuit breaker. Stationary plate 14100 can fully or partially define a breaker handle opening 14200, which can be adapted to receive a handle of the first circuit breaker. Stationary plate 14100 can define a fastener opening 14400 adapted to receive a fastener 14900. Fastener 14900 can be adapted to releasably attach stationary plate 14100 to the breaker panel, first circuit breaker, and/or second circuit breaker. Stationary plate 14100 can define one or more slidable plate receiving slots, such as a first slidable plate receiving slot 14500 and a second slidable plate receiving slot 14600. Breaker interlock device 14000 can comprise a slidable plate 14700, which can be slidably couplable and/or attachable to stationary plate 14100 via first slidable plate receiving slot 14500 and/or second slidable plate receiving slot 14600. In certain exemplary embodiments, first slidable plate receiving slot 14500 and/or second slidable plate receiving slot 14600 can be adapted to encircle slidable plate 14600. Slidable plate 14600 can be adapted to, when in a first slidable position, resist movement of the handle of the second circuit breaker from an OFF position to an ON position. Slidable plate 14600 can be adapted to, when in the first slidable position, not resist movement of the handle of the first circuit breaker from an OFF position to an ON position. Slidable plate 14600 can be adapted to, when in a second slidable position, not resist movement of the handle of the second circuit breaker from the OFF position to the ON position. Slidable plate 14600 can be adapted to, when in the second slidable position, resist movement of the handle of the first circuit breaker from an OFF position to an ON position. Stationary plate 14100 can comprise a retaining ear 14300, which can be adapted to restrain motion of stationary plate 14100 relative to one or more of the breaker panel, first circuit breaker, and/or second circuit breaker.

Figure 15:
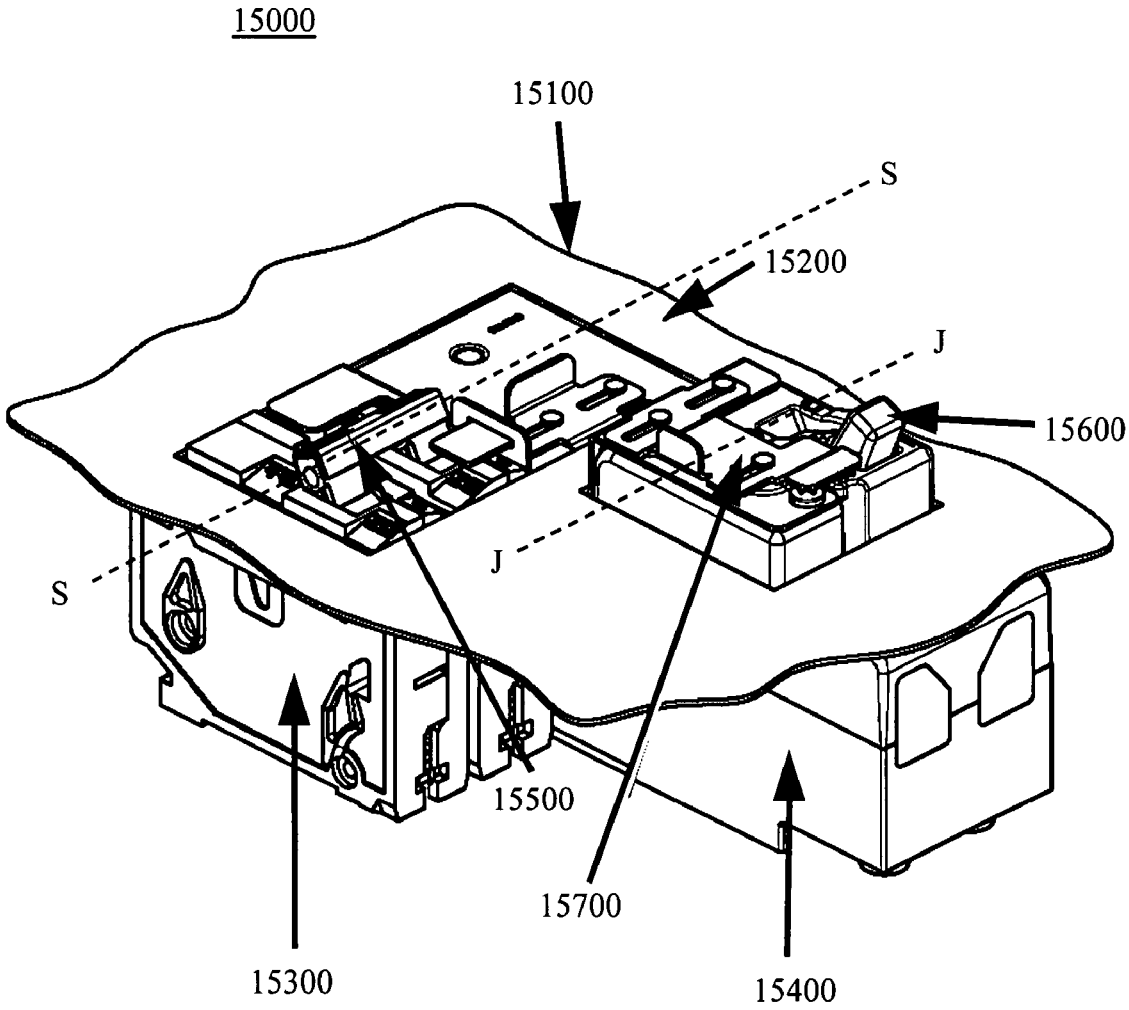
FIG. 15 is a perspective view of an exemplary system 15000.

FIG. 15 is a perspective view of an exemplary system 15000, which can comprise a breaker panel 15100. Breaker panel 15100 can comprise a dead front 15200. Breaker panel 15100 can be adapted to fixedly and/or releasably mount a first circuit breaker 15300 and a second circuit breaker 15400. First circuit breaker 15300 can comprise a handle 15500. Second circuit breaker 15400 can comprise a handle 15600. System 15000 can comprise a breaker interlock device 15700, which can be adapted to mechanically resist switching handle 15500 of first circuit breaker 15300 from an OFF position to an ON position when handle 15600 of second circuit breaker 15400 is in an ON position. In certain exemplary embodiments, first circuit breaker 15300 can be adjacent to, in a side-by-side orientation with respect to, and/or in an offset side-by-side orientation with respect to, second circuit breaker 15400. In certain exemplary embodiments, first circuit breaker 15300 can define a first lateral axis S. Second circuit breaker 15400 can define a second lateral axis J. In certain exemplary embodiments, first lateral axis S can be substantially parallel to, and/or offset from, second lateral axis J. In certain assembled embodiments, dead front 15200 can be removable with breaker interlock device 15700 installed. Breaker interlock device 15700 can be adapted to function with dead front 15700 removed.

Figure 16:
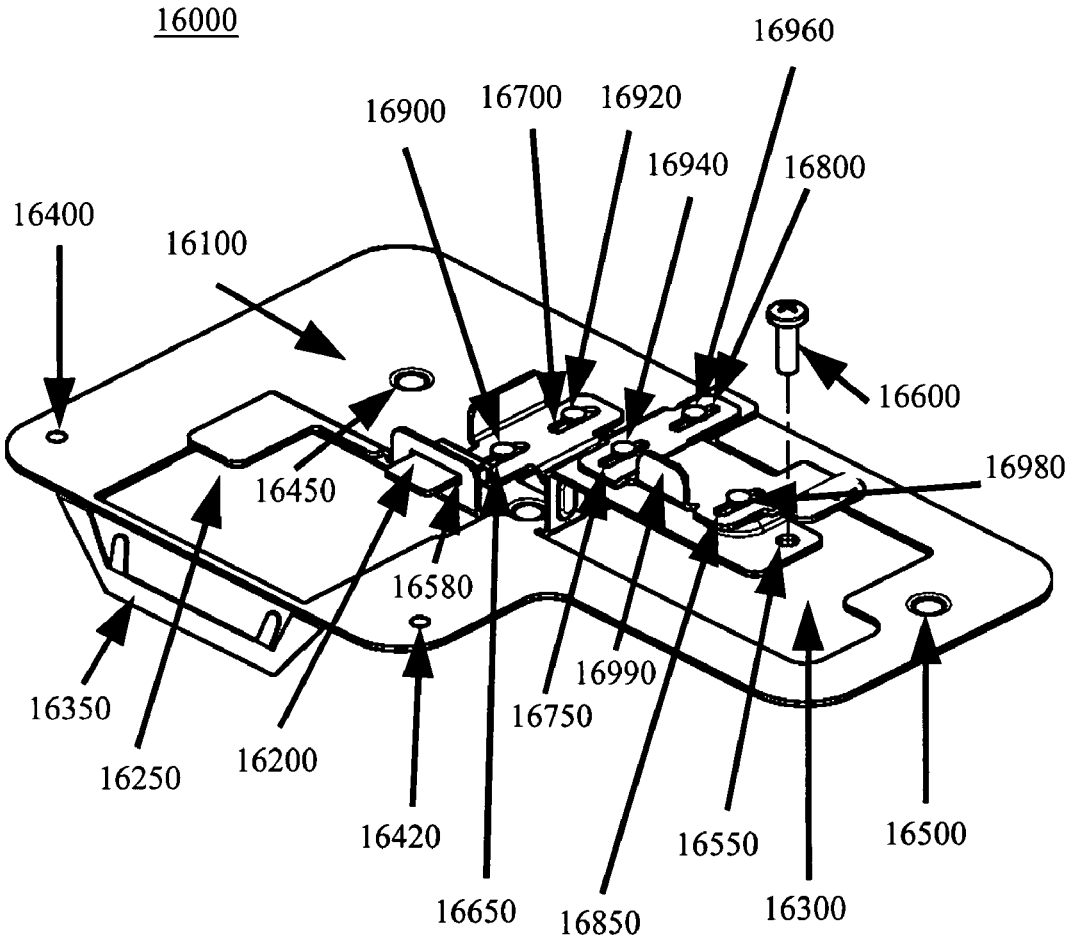
FIG. 16 is a perspective view of an exemplary embodiment of a breaker interlock device 16000.

FIG. 16 is a perspective view of an exemplary embodiment of a breaker interlock device 16000, which can be adapted for use in system 15000 of FIG. 15 as breaker interlock device 15700. Breaker interlock device 16000 can comprise a stationary plate 16100, which can be releasably attachable to a breaker panel, first circuit breaker, and/or second circuit breaker. Stationary plate 16100 can fully or partially define a first breaker handle opening 16250 and/or a second breaker handle opening 16300, which can be adapted to receive a handle of the first circuit breaker and/or a handle of the second circuit breaker. Stationary plate 16100 can define one or more fastener openings such as a first fastener opening 16400, second fastener opening 16420, third fastener opening 16450, fourth fastener opening 16500, and/or fifth fastener opening 16550. In certain exemplary embodiments, fifth fastener opening 16550 can be adapted to receive a fastener 16600. Fastener 16600 can be adapted to releasably attach stationary plate 16100 to the breaker panel, first circuit breaker, and/or second circuit breaker. Stationary plate 16100 can define one or more slidable plate receiving slots, such as a slidable plate receiving slot 16580. In certain operative embodiments, slidable plate receiving slot 16580 can encircle a slidable plate 16200. Slidable plate 16200 can be slidably couplable and/or attachable to stationary plate 16100 via first slidable plate receiving slot 16580.

Slidable plate 16200 can define a plurality of slots adapted to receive fasteners such as a first slot 16650, second slot 16700, third slot 16750, fourth slot 16800, and/or fifth slot 16850. A plurality of fasteners can be adapted for insertion through first slot 16650, second slot 16700, third slot 16750, fourth slot 16800, and/or fifth slot 16850 to slidably couple slidable plate 16200 to stationary plate 16100. For example a first fastener 16900, second fastener 16920, third fastener 16940, fourth fastener 16960, and/or fifth fastener 16980 can be adapted for use in each respective slot of first slot 16650, second slot 16700, third slot 16750, fourth slot 16800, and/or fifth slot 16850. Slidable plate 16200 can comprise a gripper 16990, which can be adapted to allow a user to provide a motive force to move slidable plate 16200 from a first slidable position to a second slidable position.

Slidable plate 16200 can be adapted to, when in the first slidable position, resist movement of the handle of the second circuit breaker from an OFF position to the ON position. Slidable plate 16200 can be adapted to, when in the first slidable position, not resist movement of the handle of the first circuit breaker from the OFF position to the ON position. Slidable plate 16200 can be adapted to, when in the second slidable position, not resist movement of the handle of the second circuit breaker from the OFF position to the ON position. Slidable plate 16200 can be adapted to, when in the second slidable position, resist movement of the handle of the first circuit breaker from an OFF position to an ON position. Stationary plate 16100 can comprise a retaining clip 16350, which can be adapted to restrain motion of stationary plate 16100 relative to one or more of the breaker panel, first circuit breaker, and/or second circuit breaker.

Figure 17:
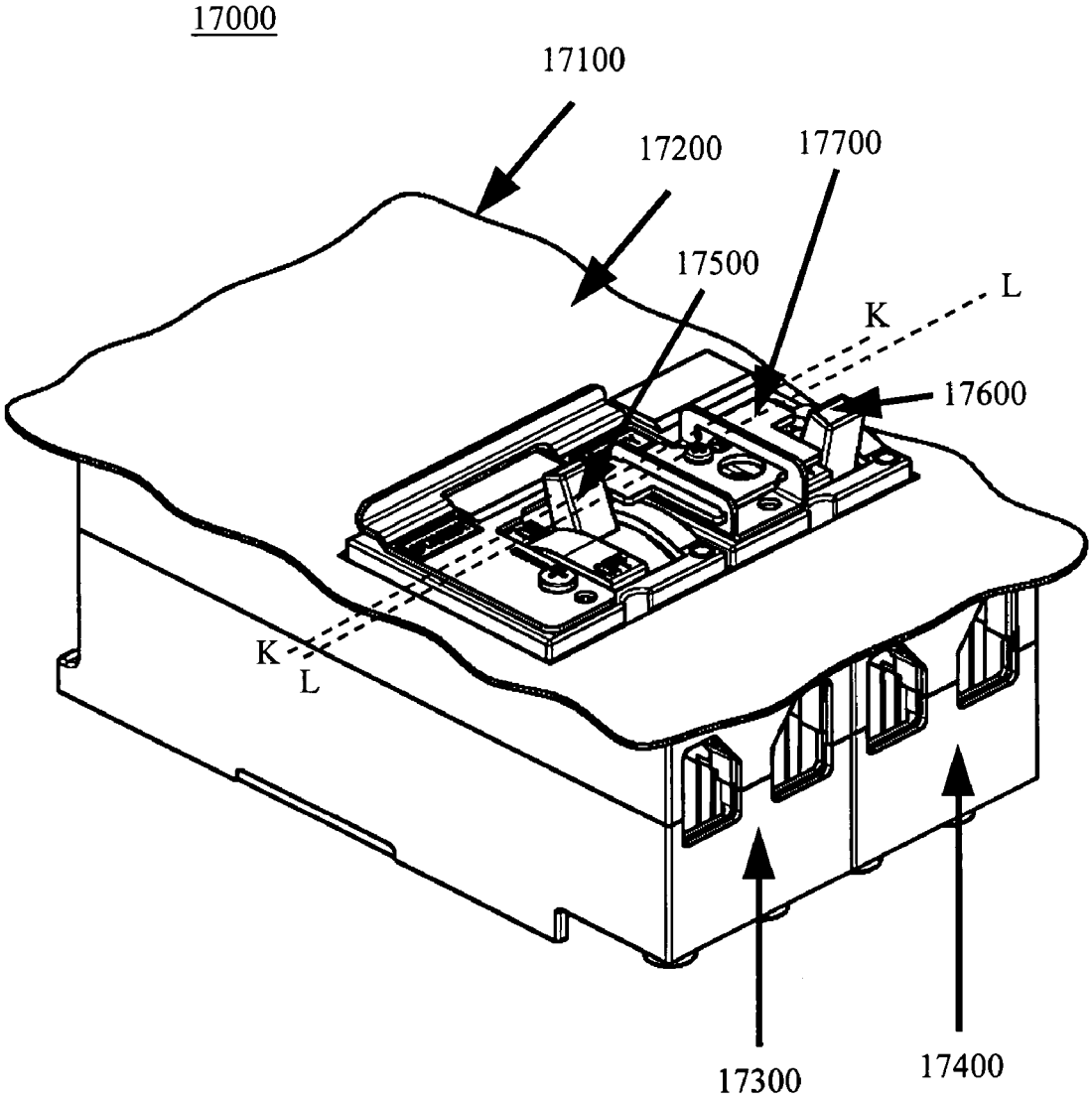
FIG. 17 is a perspective view of an exemplary system 17000.

FIG. 17 is a perspective view of an exemplary system 17000, which can comprise a breaker panel 17100. Breaker panel 17100 can comprise a dead front 17200. Breaker panel 17100 can be adapted to fixedly and/or releasably mount a first circuit breaker 17300 and a second circuit breaker 17400. First circuit breaker 17300 can comprise a handle 17500. Second circuit breaker 17400 can comprise a handle 17600. System 17000 can comprise a breaker interlock device 17700, which can be adapted to mechanically resist switching handle 17500 of first circuit breaker 17300 from an OFF position to an ON position when handle 17600 of second circuit breaker 17400 is in an ON position. In certain exemplary embodiments, first circuit breaker 17300 can be adjacent to, in a side-by-side orientation with respect to, and/or in an offset side-by-side orientation with respect to, second circuit breaker 17400. In certain exemplary embodiments, first circuit breaker 17300 can define a first lateral axis K. Second circuit breaker 17400 can define a second lateral axis L. In certain exemplary embodiments, first lateral axis K can be substantially parallel to, and/or offset from, second lateral axis L. In certain assembled embodiments, dead front 17200 can be removable with breaker interlock device 17700 installed. Breaker interlock device 17700 can be adapted to function with dead front 17700 removed.

Figure 18:
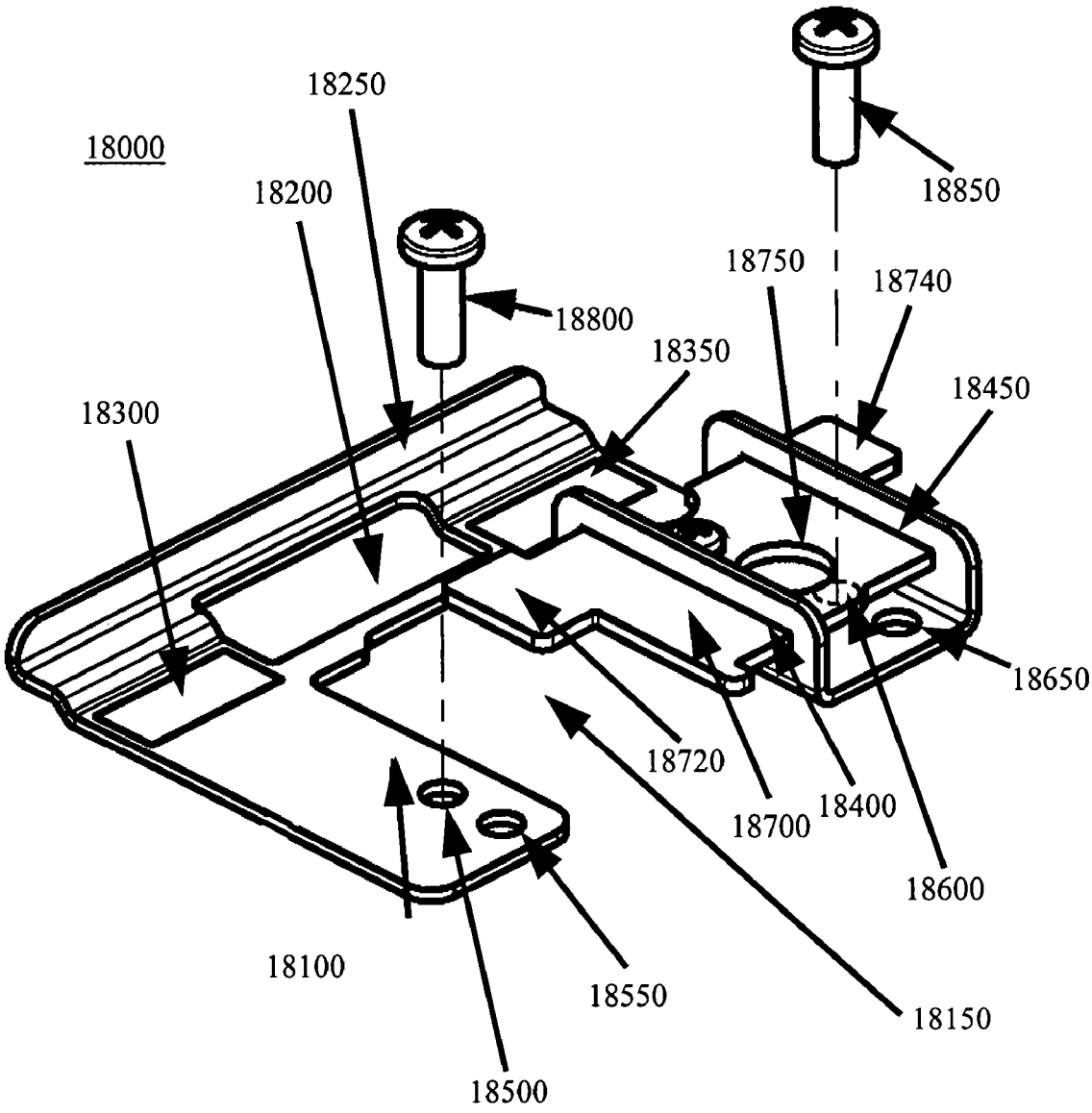
FIG. 18 is a perspective view of an exemplary embodiment of a breaker interlock device 18000.

FIG. 18 is a perspective view of an exemplary embodiment of a breaker interlock device 18000, which can be adapted for use in system 17000 of FIG. 17 as breaker interlock device 17700. Breaker interlock device 18000 can comprise a stationary plate 18100, which can be releasably attachable to a breaker panel, first circuit breaker, and/or second circuit breaker. Stationary plate 18100 can fully or partially define a breaker handle opening 18150, which can be adapted to receive a handle of the first circuit breaker. Stationary plate 18100 can define one or more breaker contour openings such as a breaker contour opening 18200, which can be adapted to receive at least a first portion of a breaker escutcheon. Stationary plate 18100 can comprise a breaker flange 18250, which can be adapted to fit a contour of at least a second portion of the breaker escutcheon. Stationary plate 18100 can comprise one or more label receiving surfaces, such as a label receiving surface 18300 and a label receiving surface 18350. Each of label receiving surface 18300 and label receiving surface 18350 can be adapted to receive a label providing information regarding one or more of the breaker panel, first breaker, second breaker, and/or breaker interface interlock 18000, etc. Stationary plate 18100 can define one or more fastener openings such as a first fastener opening 18500, second fastener receiving opening 18550, third fastener receiving opening 18600, and/or fourth fastener receiving opening 18650. In certain exemplary embodiments, first fastener receiving opening 18500 can be adapted to receive a fastener 18800. In certain exemplary embodiments, fourth fastener receiving opening 18600 can be adapted to receive a fastener 18850. Fastener 18800 and/or fastener 18850 can be adapted to releasably attach stationary plate 18100 to the breaker panel, first circuit breaker, and/or second circuit breaker. Stationary plate 18100 can define one or more slidable plate receiving slots, such as a first slidable plate receiving slot 18400 and a second slidable plate receiving slot 18450.

Figure 22:
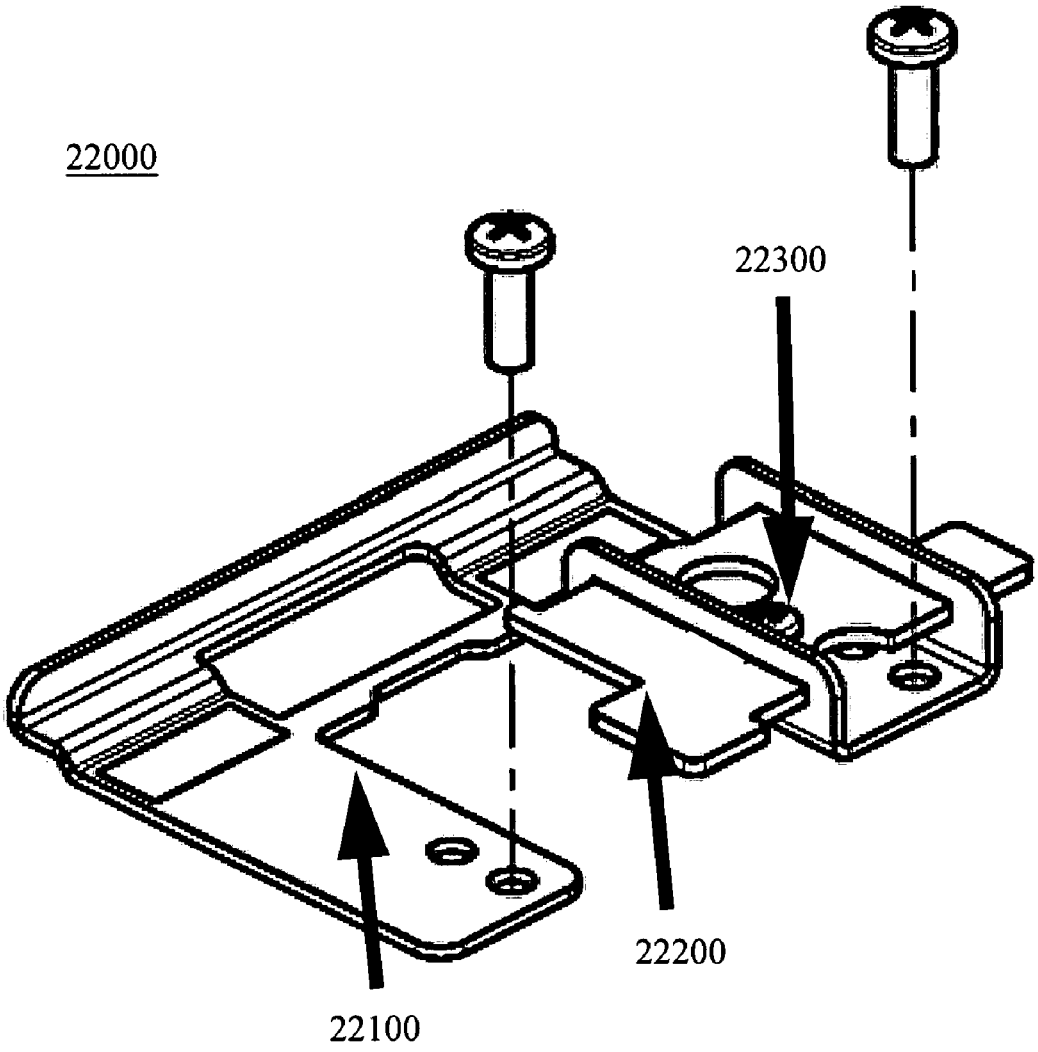
FIG. 22 is a perspective view of an exemplary embodiment of a breaker interlock device 22000.

Breaker interlock device 18000 can comprise a slidable plate 18700, which can be slidably couplable and/or attachable to stationary plate 18100 via first slidable plate receiving slot 18400 and/or second slidable plate receiving slot 18450. In certain exemplary embodiments, first slidable plate receiving slot 18400 and/or second slidable plate receiving slot 18450 can encircle slidable plate 18700. Slidable plate 18700 can comprise a body, a first ear 18720, and a second ear 18740. In certain operative embodiments, first ear 18720 can be adapted to contact the handle of the first breaker. In certain operative embodiments, second ear 18740 can be adapted to contact the handle of the second breaker. Slidable plate 18700 can comprise fastener clearance hole 18750, which can be adapted to allow slidable plate 18700 to move from a first slidable position to a second slidable position with fastener 18850 installed through fourth fastener receiving opening 18600. In certain exemplary embodiments, slidable plate 18700 can be reversible in that the first ear and the second ear can be positioned on an opposing side of first slidable plate receiving slot 18400 and second slidable plate receiving slot 18450 compared to that illustrated in breaker interlock device 18000, such as illustrated in FIG. 22. Slidable plate 18700 can be adapted to, when in the first slidable position, resist movement of the handle of the second circuit breaker from an OFF position to an ON position. Slidable plate 18700 can be adapted to, when in the first slidable position, not resist movement of the handle of the first circuit breaker from an OFF position to an ON position. Slidable plate 18700 can be adapted to, when in the second slidable position, not resist movement of the handle of the second circuit breaker from the OFF position to the ON position. Slidable plate 18700 can be adapted to, when in the second slidable position, resist movement of the handle of the first circuit breaker from the OFF position to the ON position.

FIG. 22 is a perspective view of an exemplary embodiment of a breaker interlock device 22000, which can comprise a slidable plate 22200 in a reverse orientation relative to a stationary plate 22100 as compared to the arrangement illustrated in FIG. 18. The orientation of slidable plate 22200 and stationary plate 22100 can be utilized for a set of breakers comprising handles that operate in opposite directions compared to breakers interlocked by breaker interlock device 18000 of FIG. 18. An orientation of slidable plate 22200 can be changed by removal of a fastener 22300. With fastener 22300 removed, slidable plate 22200 can be slidably relocated, turned over, and slidably positioned to allow re-installation of fastener 22300. Access holes in slidable plate 22200 can be positioned such that a mounting hole in one or more breakers will be blocked if slidable plate 22200 is oriented in a wrong direction. Slidable plate 22200 can comprise markings on one or more sides to help identify which circuit breaker slidable plate 22200 should be releasably attached to.

Figure 19:
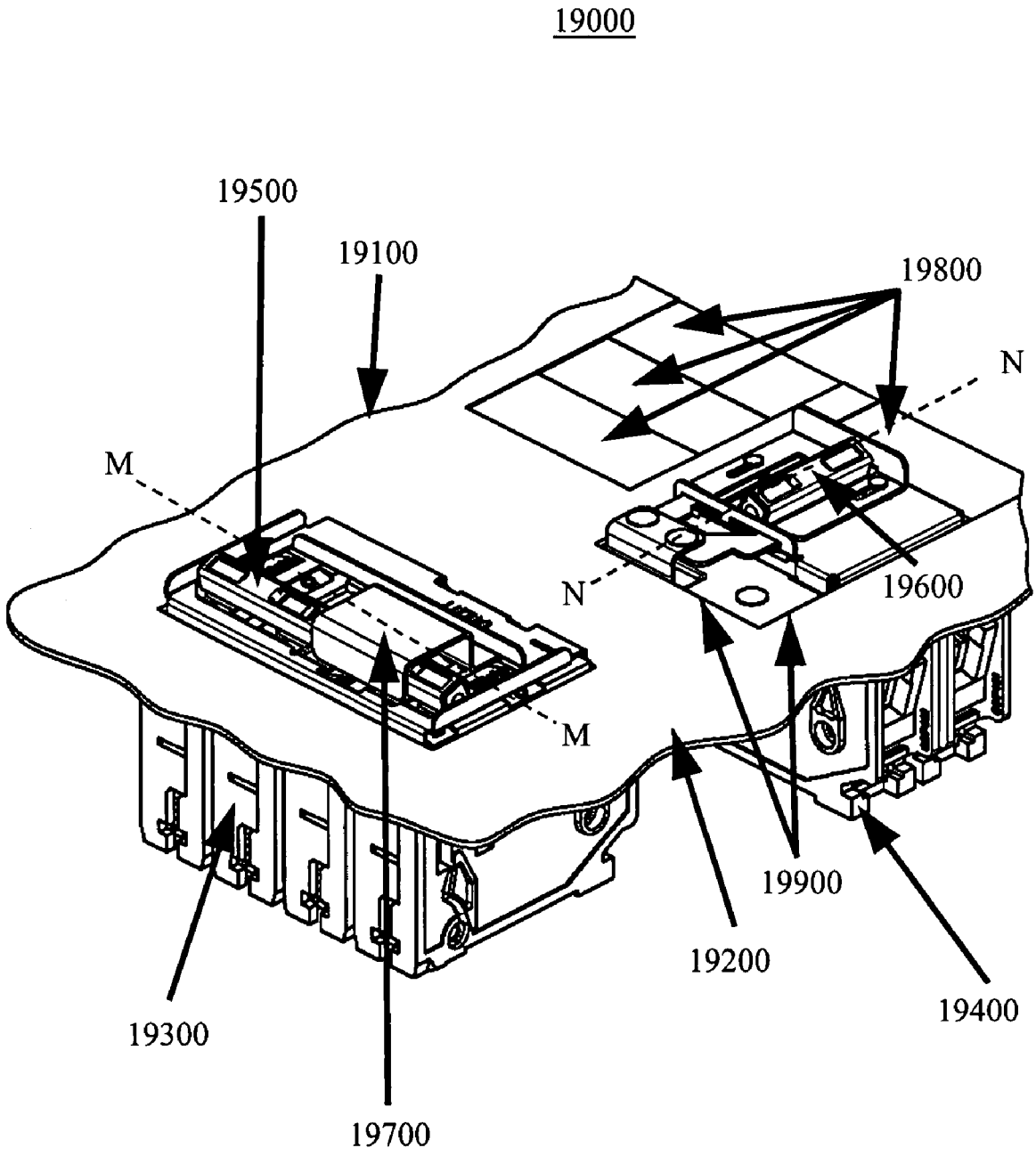
FIG. 19 is a perspective view of an exemplary system 19000.

FIG. 19 is a perspective view of an exemplary system 19000, which can comprise a breaker panel 19100. Breaker panel 19100 can comprise a dead front 19200. Breaker panel 19100 can be adapted to fixedly and/or releasably mount a first circuit breaker 19300 and a second circuit breaker 19400. In certain exemplary embodiments, each of first circuit breaker 19300 and second circuit breaker 19400 can comprise a plurality of poles. First circuit breaker 19300 can comprise a handle 19500. Second circuit breaker 19400 can comprise a handle 19600. System 19000 can comprise a breaker interlock device 19700, which can be adapted to mechanically resist switching handle 19500 of first circuit breaker 19300 from an OFF position to an ON position when handle 19600 of second circuit breaker 19400 is in an ON position. In certain exemplary embodiments, first circuit breaker 19300 can be adjacent to, in a side-by-side orientation with respect to, and/or in an offset side-by-side orientation with respect to, second circuit breaker 19400. In certain exemplary embodiments, first circuit breaker 19300 can define a first lateral axis M. Second circuit breaker 19400 can define a second lateral axis N. In certain exemplary embodiments, first lateral axis M can be substantially perpendicular to second lateral axis N. In certain assembled embodiments, dead front 19200 can be removable with breaker interlock device 19700 installed. Breaker interlock device 19700 can be adapted to function with dead front 19200 removed. In certain exemplary embodiments, breaker panel 19100 can comprise a first plurality of twist outs 19800. First plurality of twist outs 19800 can each comprise a border of relatively thin material adapted to be separated from a surface of breaker panel 19100. First plurality of twist outs 19800 can be removed prior to installation of a component and/or breaker in breaker panel 19100. For example, a second plurality of twist outs 19900 might have been removed from breaker panel 19100 to provide room to install second circuit breaker 19400.

Figure 20:
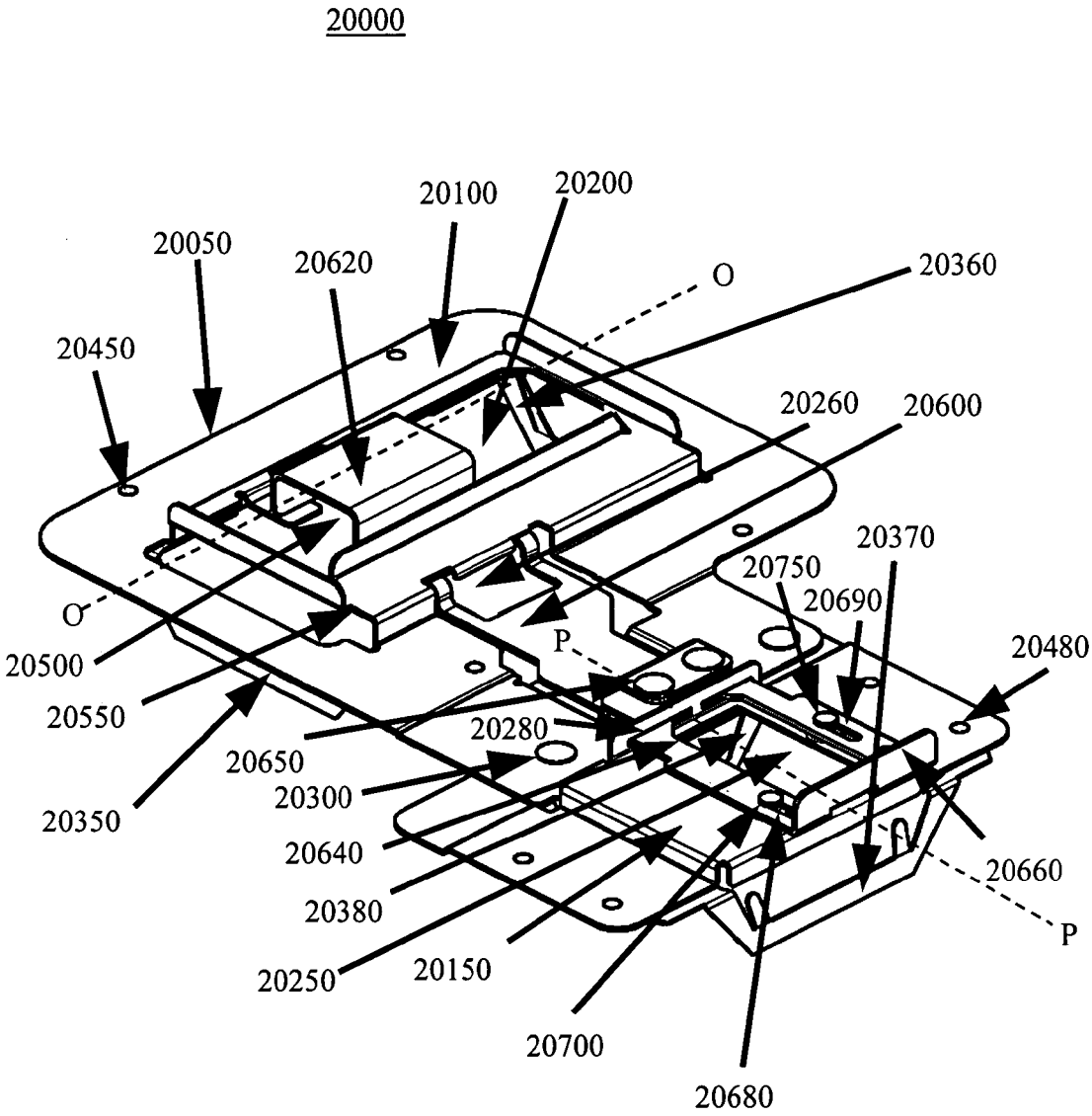
FIG. 20 is a perspective view of an exemplary embodiment of a breaker interlock device 20000.

FIG. 20 is a perspective view of an exemplary embodiment of a breaker interlock device 20000, which can be adapted for use in system 19000 of FIG. 19 as breaker interlock device 19700. Breaker interlock device 20000 can comprise a faceplate assembly 20050. In certain exemplary embodiments, faceplate assembly 20050 can be fabricated utilizing a single faceplate. In certain exemplary embodiments, faceplate assembly 20050 can comprise a first faceplate 20100 and a second faceplate 20150. First faceplate 20100 can define a first opening 20200, which can be adapted to receive a handle of a first circuit breaker. First faceplate 20100 can comprise a breaker escutcheon receiving recess 20550, which can be adapted to receive a breaker escutcheon associated with the first circuit breaker. First faceplate 20100 can define one or more slidable plate receiving slots, such as a first slidable plate receiving slot 20260. In certain operative embodiments, first slidable plate receiving slot 20260 can be adapted to encircle a first slidable plate 20600. Second faceplate 20150 can define a second opening 20250, which can be adapted to receive a handle of a second circuit breaker. Second faceplate 20150 can define one or more slidable plate receiving slots such as a second slidable plate receiving slot 20280. In certain operative embodiments, first slidable plate receiving slot 20280 can be adapted to encircle slidable plate 20600.

One or more fasteners, such as fastener 20300 can be adapted to fixedly and/or releasably couple first faceplate 20100 to second faceplate 20150. Breaker interlock device 20000 can be fixedly and/or releasably attached to one or more of the first circuit breaker, the second circuit breaker, and/or a breaker panel by a first clip 20350, second clip 20360, third clip 20370, and/or fourth clip 20380. Breaker interlock device 20000 can define one or more fastener receiving holes such as a first fastener receiving hole 20450 and/or a second fastener receiving hole 20480. Certain exemplary embodiments can comprise additional fastener receiving holes. Breaker interlock device 20000 can be fixedly or releasably attached to one or more of the first breaker, the second breaker, and/or the breaker panel via one or more fasteners via first fastener receiving hole 20450 and/or second fastener receiving hole 20480. Breaker interlock device 20000 can comprise additional fastener receiving holes to first fastener receiving hole 20450 and/or second fastener receiving hole 20480.

Breaker interlock device 2000 can define a cavity 20500, which can be adapted to receive the handle of the first circuit breaker. Cavity 20500 can define a first longitudinal axis O. The first longitudinal axis can be substantially parallel to a second longitudinal axis defined by the first circuit breaker, such as longitudinal axis M of FIG. 19. Second opening 20250 can define a third longitudinal axis P substantially parallel to a fourth longitudinal axis defined by the second circuit breaker, such as longitudinal axis N of FIG. 19. In certain exemplary embodiments, third longitudinal axis P can be substantially perpendicular to first longitudinal axis O.

Breaker interlock device 20000 can comprise a slidable plate 20600, which can be slidably couplable and/or attachable to stationary plate 20100 via first slidable plate receiving slot 20260 and/or second slidable plate receiving slot 20280. In certain exemplary embodiments, slidable plate 20600 can comprise a first slidable plate section 20620 and a second slidable plate section 20640. One or more fasteners, such as a fastener 20650 can be adapted to mechanically couple first slidable plate section 20620 to second slidable plate section 20640. Slidable plate 20600 can comprise a gripper 20660, which can be adapted to allow a user to provide a motive force to move slidable plate 20600 from a first slidable position to a second slidable position.

Slidable plate 20600 can define a plurality of slots adapted to receive fasteners such as a first slot 20680 and/or a second slot 20690. A plurality of fasteners can be adapted for insertion through first slot 20680 and/or a second slot 20690 to slidably couple slidable plate 20600 to stationary plate 20100. For example a first fastener 20700 and/or a second fastener 20750 can be adapted for use in each respective slot of first slot 20680 and/or second slot 20690.

Slidable plate 20600 can be adapted to, when in the first slidable position, resist movement of the handle of the second circuit breaker from an OFF position to an ON position. Slidable plate 20600 can be adapted to, when in the first slidable position, not resist movement of the handle of the first circuit breaker from an OFF position to an ON position. Slidable plate 20600 can be adapted to, when in the second slidable position, not resist movement of the handle of the second circuit breaker from the OFF position to the ON position. Slidable plate 20600 can be adapted to, when in the second slidable position, resist movement of the handle of the first circuit breaker from the OFF position to the ON position.

Figure 21:
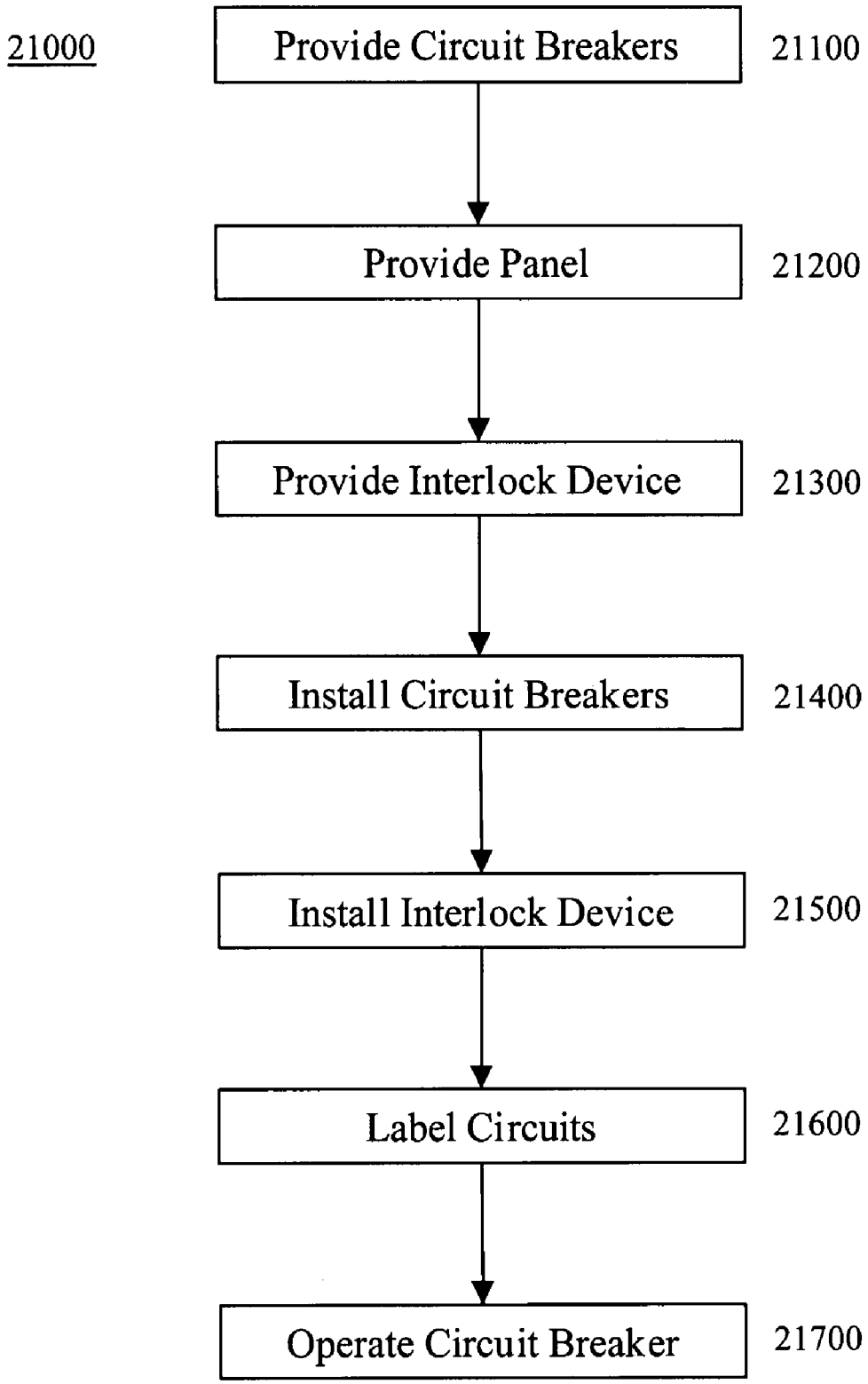
FIG. 21 is a flowchart of an exemplary embodiment of a method 21000.

FIG. 21 is a flowchart of an exemplary embodiment of a method 21000. At activity 21100, a plurality of circuit breakers can be provided. The plurality of circuit breakers can be adapted for use with a breaker interlock device.

At activity 21200, a breaker panel can be provided. The breaker panel can be adapted to releasably house the plurality of circuit breakers.

At activity 21300, the breaker interlock device can be provided. The breaker interlock device can be adapted for use with adjacent circuit breakers. The adjacent circuit breakers can be in a side-by-side orientation, offset side-by-side orientation, vertical orientation, and/or any other orientation wherein a first circuit breaker is in proximity with a second circuit breaker.

At activity 21400, the plurality of circuit breakers can be installed in the breaker panel. In certain exemplary embodiments, the plurality of circuit breakers can be releasably attached to the breaker panel via one or more screws, clamps, clips, spring loaded latches, latches, straps, and/or rivets, etc.

At activity 21500, the breaker interlock device can be installed. The breaker interlock device can be adapted to, when in a first position, to resist movement of a handle of a second circuit breaker from an OFF position to an ON position. The breaker interlock device can be adapted to, when in the first position, not resist movement of a handle of a first circuit breaker from an OFF position to an ON position. The breaker interlock device can be adapted to, when in a second position, not resist movement of the handle of the second circuit breaker from the OFF position to the ON position. The breaker interlock device can be adapted to, when in the second slidable position, resist movement of the handle of the first circuit breaker from the OFF position to the ON position.

At activity 21600, the circuits can be labeled to reflect their function. For example, a first circuit can be labeled to reflect that it carries power supplied by a traditional utility, and a second circuit can be labeled to reflect that it carries power supplied by an emergency generator. The labels can be applied to predetermined circuit identification labeling areas, which are positioned to remain visible regardless of the positioning and/or operation of the breaker interlock device associated with the plurality of circuit breakers.

At activity 21700, at least one of the circuit breakers can be operated. For example, with the breaker interlock device installed and in the first position, the handle of the first circuit breaker can be moved from the OFF position to the ON position.

Still other practical and useful embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application.

Thus, regardless of the content of any portion (e.g., title, field, background, summary, abstract, drawing figure, etc.) of this application, unless clearly specified to the contrary, such as via an explicit definition, assertion, or argument, with respect to any claim, whether of this application and/or any claim of any application claiming priority hereto, and whether originally presented or otherwise:

- there is no requirement for the inclusion of any particular described or illustrated characteristic, function, activity, or element, any particular sequence of activities, or any particular interrelationship of elements;
- any elements can be integrated, segregated, and/or duplicated;
- any activity can be repeated, any activity can be performed by multiple entities, and/or any activity can be performed in multiple jurisdictions; and
- any activity or element can be specifically excluded, the sequence of activities can vary, and/or the interrelationship of elements can vary.

Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all subranges therein. Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

What is claimed is:

1. A system comprising:

a breaker interlock device adapted to mechanically resist switching a handle of a first circuit breaker from an OFF position to an ON position when a handle of a second circuit breaker is in an ON position, said first circuit breaker adjacent to said second circuit breaker, said breaker interlock device comprising:

a stationary plate releasably attachable to said first circuit breaker and/or said second circuit breaker, said stationary plate defining a fastener opening adapted to receive a fastener, said fastener adapted to releasably attach said stationary plate to said first circuit breaker and/or said second circuit breaker, said stationary plate at least defining a portion of a breaker handle opening adapted to receive said handle of said first circuit breaker, said stationary plate defining a slidable plate receiving slot, said slidable plate receiving slot entirely defined by an opening in a flange of said stationary plate; and a slidable plate attachable to said stationary plate via said slidable plate receiving slot, said slidable plate adapted to, when in a first slidable position, resist movement of said handle of said second circuit breaker from an OFF position to said ON position, said slidable plate adapted to, when in said first slidable position, not resist movement of said handle of said first circuit breaker from said OFF position to said ON position, said slidable plate adapted to, when in a second slidable position, not resist movement of said handle of said second circuit breaker from said OFF position to said ON position, said slidable plate adapted to, when in said second slidable position, resist movement of said handle of said first circuit breaker from said OFF position to said ON position.

2. The system of claim 1, further comprising:

said first circuit breaker.

3. The system of claim 1, further comprising:

said second circuit breaker.

4. The system of claim 1, further comprising:

a breaker panel adapted to releasably house said first circuit breaker and said second circuit breaker, said breaker panel comprising a dead front, said dead front adapted to be removable with said breaker interlock device installed, said breaker interlock device adapted to function with said dead front removed.

5. The system of claim 1, wherein said breaker interlock device is adapted for said first circuit breaker and said second circuit breaker to be in an offset side-by-side orientation.

6. The system of claim 1, wherein said stationary plate comprises a retaining ear adapted to restrain motion of said stationary plate relative to said first circuit breaker.

7. The system of claim 1, wherein said stationary plate comprises a retainer clip adapted to restrain motion of said stationary plate relative to said first circuit breaker.

8. The system of claim 1, wherein said first circuit breaker defines a first lateral axis and said second circuit breaker defines a second lateral axis, said first lateral axis substantially parallel to, and offset from, said second lateral axis.

9. The system of claim 1, wherein said stationary plate defines said breaker handle opening adapted to receive said handle of said first circuit breaker.

* * * * *